US009770811B2

(12) United States Patent
Wirth et al.

(10) Patent No.: US 9,770,811 B2
(45) Date of Patent: Sep. 26, 2017

(54) RATCHET AND SOCKET ASSEMBLY

(71) Applicant: Apex Brands, Inc., Sparks, MD (US)

(72) Inventors: Jason M. Wirth, Baltimore, MD (US); Timothy T. McKenzie, Westminster, MD (US); Mark J. Momola, Portland, OR (US); Jonathan S. Beckwith, Charlotte, NC (US); Alan D. Anderson, Willow Spring, NC (US)

(73) Assignee: APEX BRANDS, INC., Apex, NC (US)

( * ) Notice: Subject to any disclaimer, the term of this patent is extended or adjusted under 35 U.S.C. 154(b) by 87 days.

(21) Appl. No.: 14/516,520

(22) Filed: Oct. 16, 2014

(65) Prior Publication Data

US 2015/0101950 A1 Apr. 16, 2015

Related U.S. Application Data

(60) Provisional application No. 61/891,537, filed on Oct. 16, 2013.

(51) Int. Cl.

| | |
|---|---|
| ***B25B 13/46*** | (2006.01) |
| ***B25H 3/06*** | (2006.01) |
| ***B25B 23/00*** | (2006.01) |

(52) U.S. Cl.

CPC ..... *B25B 13/463* (2013.01); *B25B 13/468* (2013.01); *B25B 23/0035* (2013.01); *B25H 3/06* (2013.01)

(58) Field of Classification Search

CPC . B25B 13/463; B25B 13/468; B25B 23/0035; B25H 3/06

(Continued)

(56) References Cited

U.S. PATENT DOCUMENTS 3,438,291 A * 4/1969 Bergquist ..... B25B 13/463 74/527
4,218,940 A * 8/1980 Main ..... B25B 13/06 81/177.85

(Continued)

FOREIGN PATENT DOCUMENTS

CN 2411080 12/2000
CN 2411872 12/2000

(Continued)

OTHER PUBLICATIONS

International Search and Written Opinion dated May 28, 2015, for corresponding PCT application No. PCT/US2014/060974.

(Continued)

*Primary Examiner* — Hadi Shakeri
(74) *Attorney, Agent, or Firm* — McNair Law Firm, P.A.

(57) ABSTRACT

A ratcheting tool has a drive tang with a socket retaining detent and a linkage to engage the detent. A locking element is disposed movably between a first position wherein the locking element engages the linkage when a first actuator is in a first position so that the locking element blocks movement of the linkage so that the detent remains in a socket-retaining position and a second position in which the locking element disengages the linkage. A storage device for retaining sockets has a frame and one or more docks attached to the frame, each dock having a first retainer member, a second retainer member, and a third retainer member, at least one of which is selectively movable with respect to a socket receiving space so that a socket is removable from the socket receiving space.

22 Claims, 35 Drawing Sheets

(58) Field of Classification Search
USPC ..... 81/63
See application file for complete search history.

(56) References Cited

U.S. PATENT DOCUMENTS

| | | | | |
|---|---|---|---|---|
| 4,420,995 | A | 12/1983 | Roberts | |
| 4,848,196 | A | 7/1989 | Roberts | |
| 5,178,047 | A | 1/1993 | Arnold et al. | |
| 5,199,330 | A | 4/1993 | Arnold et al. | |
| 5,199,335 | A | 4/1993 | Arnold et al. | |
| 5,386,747 | A | 2/1995 | Grover | |
| 5,553,427 | A | 9/1996 | Andres | |
| 5,582,080 | A * | 12/1996 | Barmore | B25B 23/0035 81/177.85 |
| 5,644,958 | A | 7/1997 | Roberts et al. | |
| 5,671,643 | A | 9/1997 | Henkhaus | |
| 5,697,267 | A | 12/1997 | Tsai | |
| 5,782,147 | A | 7/1998 | Chaconas et al. | |
| 6,044,730 | A | 4/2000 | Roberts et al. | |
| 6,109,140 | A * | 8/2000 | Roberts | B25B 13/463 81/177.85 |
| 6,134,991 | A | 10/2000 | Chaconas | |
| 6,161,454 | A | 12/2000 | Chaconas | |
| 6,205,890 | B1 | 3/2001 | Roberts et al. | |
| 6,230,591 | B1 | 5/2001 | Ling et al. | |
| 6,260,448 | B1 | 7/2001 | Chaconas | |
| 6,629,477 | B2 | 10/2003 | Ling et al. | |
| 6,711,973 | B2 | 3/2004 | Arnold et al. | |
| 6,868,759 | B2 | 3/2005 | Tuan-Mu | |
| 6,918,323 | B2 | 7/2005 | Arnold et al. | |
| 6,971,287 | B2 | 12/2005 | Lee et al. | |
| 6,988,429 | B2 | 1/2006 | Lee et al. | |
| 7,584,686 | B2 * | 9/2009 | Tsai | B25B 23/0035 81/177.85 |
| 7,954,402 | B2 * | 6/2011 | Crawford | B25B 23/0035 81/177.85 |

FOREIGN PATENT DOCUMENTS

| | | |
|---|---|---|
| CN | 1280531 | 1/2001 |
| DE | 202007014032 | 12/2007 |
| EP | 0945225 B1 | 4/2003 |
| WO | WO 99/52681 | 10/1999 |

OTHER PUBLICATIONS

Annex to Form PCT/ISA/206, Communication Relating to the Results of the Partial International Search dated Jan. 28, 2015, for corresponding PCT application No. PCT/US2014/060974.
Chinese First Office Action dated Jan. 4, 2017, for corresponding application No. 201480068553.9.

* cited by examiner

RATCHET AND SOCKET ASSEMBLY

CLAIM OF PRIORITY

This application claims priority to U.S. Provisional Patent Application No. 61/891,537 filed Oct. 16, 2013, the entire disclosure which is incorporated herein.

FIELD OF THE INVENTION

The present invention is directed to hand tools. More particularly, the present invention is related to hand tools including retention mechanisms for working at height.

BACKGROUND OF THE INVENTION

It is known for individuals working with tools at heights to employ mechanisms to retain the tools to the individual in the event the individual drops the tool. Such tools, for example ratchets, sockets and wrenches, may be tied off or tethered to the worker or to the structure or material upon which the individual is working. Tools may be tethered to the worker, structure, or to a work bag hoisted to the work area. Typically, standard hand tools are modified to allow for tethering, for example by drilling holes through the tool body and attaching retaining straps or rings through the holes to allow tie-off by a tether. Other methods of tethering directly to a tool include applying a tether by an adhesive strap or tape or applying a tethered carabiner or tethered lanyard. Workers may sometimes prefer not to work with tethered tools, however, because their use can sometimes be considered cumbersome.

The present invention recognizes and addresses considerations of prior art constructions and methods.

SUMMARY OF THE INVENTION

One embodiment of the present invention provides a ratcheting tool for driving a socket having a body with a head that defines a cavity and an elongated handle extending away from the head. A ratchet member having an annular ratchet portion is disposed in the cavity so that the ratchet portion is rotatable about an axis, and a drive tang extends from the ratchet portion externally of the body and so that the drive tang rotates with the ratchet portion about the axis. A pawl is disposed in the body in communication with the ratchet portion selectively between a first position, in which the pawl transmits torque from the body to the ratchet portion in a first rotational direction with respect to the axis and ratchets with respect to the ratchet portion in response to torque from the body in a second rotational direction with respect to the axis opposite the first direction, and a second position, in which the pawl transmits torque from the body to the ratchet portion in the second rotational direction and ratchets with respect to the ratchet portion in response from torque from the body in the first rotational direction. A detent is disposed in the drive tang so that the detent is reciprocally moveable in the direction transverse to the axis between a first position and a second position, wherein the first position extends further from the axis than does the second position. A linkage extends through the drive tang to engagement with the detent. The linkage is accessible at a surface of the ratcheting tool and engages the detent so that when the linkage is in a first position, the detent is in its first position and so that actuation of the linkage to a second position causes the linkage to move the detent to its second position. A locking element is disposed pivotally with respect to the ratchet member. The locking element is pivotal between a first position wherein the locking element engages the linkage when the linkage is in its first position so that the locking element blocks the actuation of the linkage, and a second position in which the locking element disengages from the linkage with respect to the locking element's first position.

In a further embodiment of the present invention, a body has a head that defines a first compartment and has an elongated handle extending longitudinally away from the head. The elongated handle defines a longitudinal first axis. The body defines a second compartment that communicates with the first compartment. An annular ratchet member is disposed in the first compartment so that the ratchet member is rotatable about a second axis that is perpendicular to the first axis. The ratchet member defines a plurality of ratchet teeth on an outer circumference thereof. A pawl is disposed in the second compartment defined by the body so that the pawl is moveable in the second compartment between a first position, in which the pawl transmits torque from the body to the ratchet member in a first rotational direction with respect to the second axis and ratchets with respect to the ratchet member in response to torque from the body in a second rotational direction with respect to the second axis opposite the first direction, and a second position, in which the pawl transmits torque from the body to the ratchet member in the second rotational direction and ratchets with respect to the ratchet member in response to torque from the body in the first rotational direction. A drive tang extends from the ratchet member so that the drive tang rotates with the ratchet member about the second axis. A detent is disposed in the drive tang so that the detent is reciprocally moveable between a first position, in which the detent extends beyond an outer surface of the drive tang a distance to engage a receiving structure in an internal surface of a socket when received on the drive tang and retain the socket on the drive tang from movement off of the drive tang in a direction along the second axis, and a second position inward of the distance with respect to the second axis so that the socket disposed on the drive tang is moveable off of the drive tang in the direction along the second axis. A linkage extends through the ratchet and the drive tang from the detent to a surface of ratchet member opposite the drive tang. The linkage has a push member at the surface and a first resilient member in communication with the push member so that the first resilient member biases the push member to a first position. The push member is linked to the detent through the linkage so that when the push member is in its first position, the detent is in its first position and so that actuation of the push member against the bias moves the linkage to a second position to drive the detent to its second position. A locking element is disposed pivotally with respect to the ratchet member. A second resilient element is disposed between the ratchet member and the locking element so that the second resilient element biases the locking element toward engagement with the linkage. The locking element and the linkage are disposed and configured with respect to each other so that, when the locking element engages the linkage in response to bias from the second resilient element when the push member is in its first position, the locking element blocks movement of the push member from its first position to its second position. An actuator is disposed at the surface movably with respect to the linkage and in communication with the locking element so that movement of the actuator moves the locking element away from engagement of the linkage.

A storage device for retaining sockets having a body portion defining an internal cavity with a drive cavity for receipt of a fastener and a receiving aperture for receipt of a drive tang of ratchet has a frame and one or more docks attached to the frame. Each dock as a first retainer member having an engaging surface in a first dimension. A second retainer member is disposed with respect to the first retainer member in a first position thereof so that the first retainer member and the second retainer member define a socket receiving space having a longitudinal axis perpendicular to the first dimension so that when a socket is disposed in a retained position in the socket receiving space, a diameter of the drive cavity of the socket is aligned perpendicular to the longitudinal axis and the height of the socket is aligned with the longitudinal axis. The dock has a third retainer member. The first retainer member, the second retainer member, and the third retainer member are disposed with respect to each other in the first position so that the third retainer member is adjacent the socket receiving space, the second retainer member is disposed between the first retainer member and the second retainer member, the first retainer member retains the socket in a first direction parallel to the longitudinal axis, the second retainer member retains the socket in a second direction perpendicular to the longitudinal axis, and the third retainer member retains the socket in a third direction opposite the first direction. In a second position of the first retainer member, the second retainer member, and the third retainer member, at least one of the second retainer member and third retainer member is selectively moveable with respect to the socket receiving space from the first position so that the socket is removable from the socket receiving space.

In a still further embodiment, a ratcheting tool for driving a socket has a body with a head that defines a cavity and an elongated handle extending away from the head. A ratchet member having an annular ratchet portion is disposed in the cavity so that the ratchet portion is rotatable about an axis, and a drive tang extends from the ratchet portion externally of the body and so that the drive tang rotates with the ratchet portion about the axis. A pawl is disposed in the body in communication with the ratchet portion selectively between a first position, in which the pawl transmits torque from the body to the ratchet portion in a first rotational direction with respect to the axis and ratchets with respect to the ratchet portion in response to torque from the body in a second rotational direction with respect to the axis opposite the first direction, and a second position, in which the pawl transmits torque from the body to the ratchet portion in the second rotational direction and ratchets with respect to the ratchet portion in response from torque from the body in the first rotational direction. A detent is disposed in the drive tang so that the detent is reciprocally moveable in the direction transverse to the axis between a first position and a second position, wherein the first position extends further from the axis than does the second position. A linkage extends through the drive tang to engagement with the detent. The linkage is accessible at a surface of the ratcheting tool and engages the detent so that when the linkage is in a first position, the detent is in its first position and so that actuation of the linkage to a second position causes the linkage to move the detent to its second position. A locking element is disposed within the cavity and is movable between a first position wherein the locking element engages the linkage when the linkage is in its first position so that the locking element blocks the actuation of the linkage, and a second position in which the locking element disengages from the linkage with respect to the locking element's first position.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
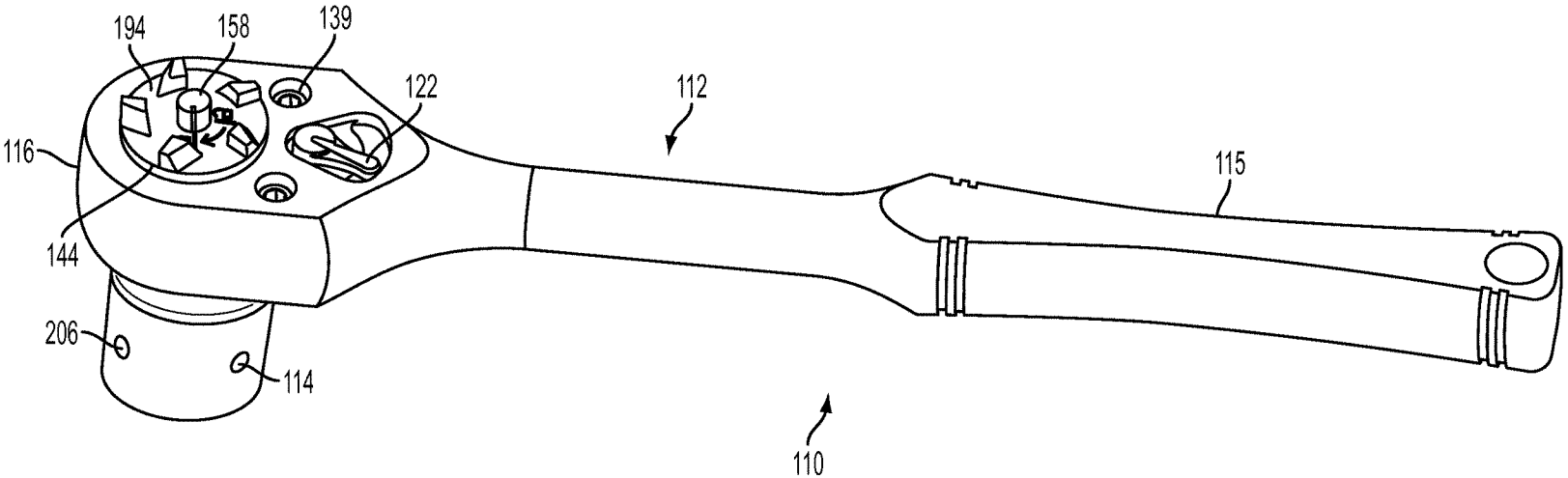
FIGS. 1A and 1B are perspective and partial perspective views of a ratchet and socket system according to an embodiment of the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1B:
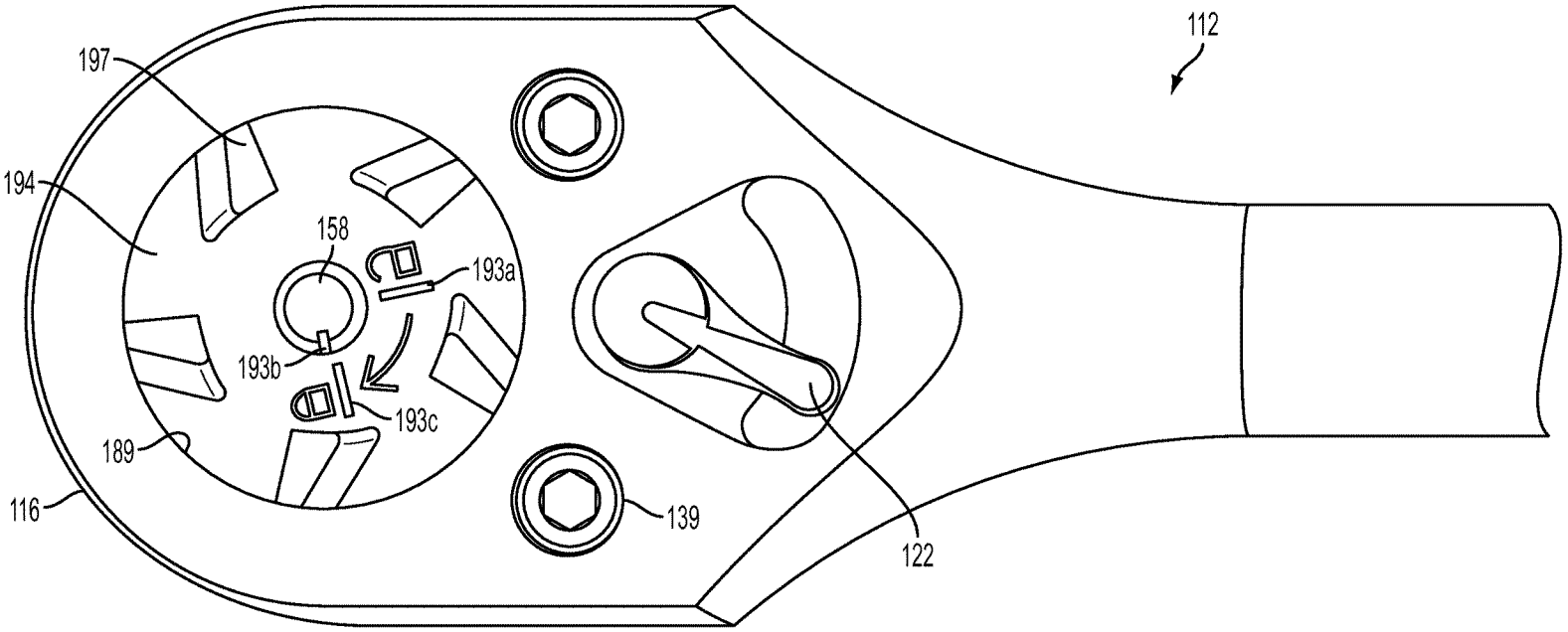

Referring now to FIGS. 1A and 1B, a ratchet and socket assembly 110 includes a ratchet 112 to which is attached a socket 114. Ratchet 112 has a body comprising an elongated handle portion 115 attached to and extending from a head portion 116. A cavity 118 (FIG. 2) is formed in head 116 from the top to the bottom of the head. Body 115 need not be symmetrical but in the illustrated embodiments defines a center or bisecting (if symmetrical) vertical plane (in the perspective of FIG. 2) that includes the center axis of a generally cylindrical through-portion of cavity 118. A line extending through body 115 in this plane that intersects and is perpendicular to the axis of cavity 118 may be considered an axis of elongated handle portion 115.

A ratchet member or wheel 120 is disposed in the cavity through-portion that defines a series of vertically aligned (in the perspective of FIG. 2) teeth 130 that extend entirely about the outer circumference 131 of ratchet wheel 120 and vertically from top to bottom of the outer circumference. A pawl 167 is disposed in the cavity through-portion between the ratchet wheel and the handle. The portion of the forging between the handle and the round part of the head may be considered a web between these two body components, and in that event the pawl may be considered to be received in a cavity or chamber portion 126 of cavity 118 in the web that opens to the cavity through-portion and opens also to the ambient environment through a top surface 119 of the body or web. Accordingly, the body may be considered to have a general cavity 118 comprising the circular cavity through-portion that is distal to body handle portion 115 and pawl cavity portion 126 proximate the handle portion and that may be of circular or other cross-sectional shape, depending on the pawl configuration. The cavity through-portion and cavity portion 126 are formed from the bottom surface of the body (in the perspective shown in FIG. 2) and extend upwardly into the handle and head body portions. The cavity portions may be formed by boring, milling, forging, casting or other means known in the art. The cavity portions partially overlap one another, and each (in embodiments in which both have circular cross sections) has a respective center, diameter, and axis through the respective centers. As noted above, the axis of the cavity through-portion intersects the longitudinal axis of handle 115. The cavity portion axes are substantially parallel to each other. Pawl cavity 126 is smaller in volume (and, where circular in cross section, in diameter) than the through-portion of cavity 118. Top surface 119 of the body has a pair of openings formed therein that communicate the respective individual cavity portions to the ambient environment. The first opening is circular and concentrically communicates with the cavity through-portion. The second opening is formed in a depression in top surface 119. The second opening may be circular and, where cavity portion 126 is circular in cross section, may be concentric with pawl cavity portion 126. Generally, the center axis of the circular second opening also perpendicularly intersects the axis of elongated handle 115, as discussed above with respect to the through-portion axis of cavity 118.

A reversing lever 122 is disposed in the depression through the second opening and into pawl cavity portion 126, proximate handle 115 and engaging the pawl. In the illustrated embodiment, reversing lever 122 includes a hand actuatable portion 123 extending above body surface 119 within the depression formed therein that a user may grip and turn. An elongated pin portion 125 of lever 122 is rotationally fixed to hand actuatable portion 123 and is rotationally fixed to pawl 167 through a keyed, splined, or cooperatively polygonally shaped interface between the outer surface of pin portion 125 and the inner diameter of a vertical central bore through the pawl, so that rotation of hand actuatable portion 123 translates the applied torque to pawl 167, thereby rotating pawl 167 within pawl cavity portion 126 to and between a first operative position and a second operative position with respect to ratchet wheel 120. In one embodiment, pawl cavity portion 126 is generally circular in cross section, and pawl 167 is partially correspondingly circular in cross section (i.e. partially cylindrical), so that pawl 167 rotates in pawl cavity portion 126 about the axis of cavity portion 126 in a fit between the sides of cavity portion 126 and the pawl sides that is close but that allows the pawl to rotate easily in the cavity portion in response to hand application of torque to hand actuatable portion 123 of lever 122. A front face of pawl 167 faces teeth 130 of ratchet wheel 120 at the intersection of the cavity through-portion and cavity pawl portion 126. Pawl 167 defines, on opposite sides of the pawl's front face (i.e. on opposing sides of the vertical plane that includes both the handle axis and the axis of the cavity through-portion) respective toothed sections, and in certain embodiments the toothed sections are on respective end edges of the pawl front face. The front face, and the respective toothed portions on the ends thereof, are configured so that a respective one of the toothed portions engages teeth 130 of ratchet wheel 120 when lever 122 rotates pawl 167 to the first and second operative positions.

Lever 122 is retained in ratchet 122 in the downward vertical direction (in the perspective of FIG. 2) by pawl 167. Various mechanisms may be used to retain lever 122 in cavity portion 126 in the upward vertical direction, for example a groove and/or lip configuration that cooperates with an edge of the upper opening to cavity portion 126, as disclosed in U.S. Pat. No. 5,178,047.

A spring-loaded pusher (e.g. a ball or pin, not shown) is carried in a blind bore 124 (FIG. 2) in the web portion of the body at which the head intersects the handle. A spring is disposed in the blind bore, urging the pusher to engage a pocket or depression in the pawl's rearward face. The pusher may, e.g., be a ball or may be a pin having a conical tip that is received in this rear pawl pocket. The pawl pocket may have a vertical ridge in the center so that as the reversing lever moves the pawl from one operative rotational position to the other in the pawl cavity portion 126, the pusher helps retain the pawl in the respective operative position. In one of the pawl's two operative positions, when one of the pawl's two toothed portions engages teeth 130 of ratchet wheel 120, the detent in blind bore 124 engages a portion of the pawl pocket on the side of the pawl pocket center ridge diametrically opposite the engaged pawl teeth. With the pawl in such position, application of force to handle 115 in a first rotational direction about the center axis of the through-portion cavity (or the axis of the ratchet wheel), when ratchet wheel 118 is restrained by engagement of its depending drive tang with a work piece, causes the ratchet wheel to apply reactive force to the pawl in a rotational direction that wedges the pawl against the body forging, so that continued application of torque to the handle in this direction transmits torque from the body, through the pawl, to the ratchet wheel, and from there to the work piece via the drive tang. When force is applied to the handle in the opposite rotational direction (i.e. an opposite direction about the axis of the cavity through-portion), the reaction force applied by the ratchet wheel to the pawl causes the pawl to rotate in pawl cavity 126 against the bias of the detent in blind bore 124, causing the pawl to ratchet with respect to the ratchet wheel as the ratchet wheel teeth repeatedly ride over the engaged pawl teeth that are biased toward the ratchet wheel by the detent spring. That is, ratchet 112 applies torque from the handle to the ratchet wheel/tang/work piece in a first rotational direction (about the axis of the cavity through-portion) and ratchets the pawl with respect to the ratchet wheel when the handle turns in the second rotational direction about the cavity axis, opposite the first rotational direction. Upon turning lever 122 so that pawl 167 moves to the second operative position, however, the opposing toothed portion of the face of pawl 167 engages teeth 130 of ratchet wheel 120. The pawl and ratchet wheel operation in this position is the mirror image of the first operation, causing ratchet 112 to apply torque from the handle to the ratchet wheel/tang/work piece in the second rotational direction and to ratchet the pawl with respect to the ratchet wheel when the handle turns in the first rotational direction about the cavity axis. Various pawl, lever, and pawl pocket configurations are known and understood in this art and may be used in various embodiments of the present invention, as should be understood in view of the present disclosure. For example, the pawl may be of a sliding type that moves to one side or the other of the pawl pocket under influence of the reversing lever, wedging between the ratchet wheel tooth and the body forging in one rotational direction of force applied by the handle and ratcheting against a spring-biased detent applied by the reversing lever in the other rotational direction of force applied by the handle. These structures, therefore, are not discussed in further detail herein. Examples of pawl and ratchet configurations, which may be utilized with ratchet arrangements encompassed by this disclosure, are described in U.S. Pat. Nos. 5,178,047; 5,199,330; 5,199,335; 5,553,427; 5,782,147; 6,134,991; 6,161,454; 6,230,591; 6,260,448; 6,629,477; 6,711,973; 6,868,759; 6,918,323; 6,971,287; and 6,988,429, the disclosure of each of which is incorporated herein in its entirety for all purposes.

Figure 2:
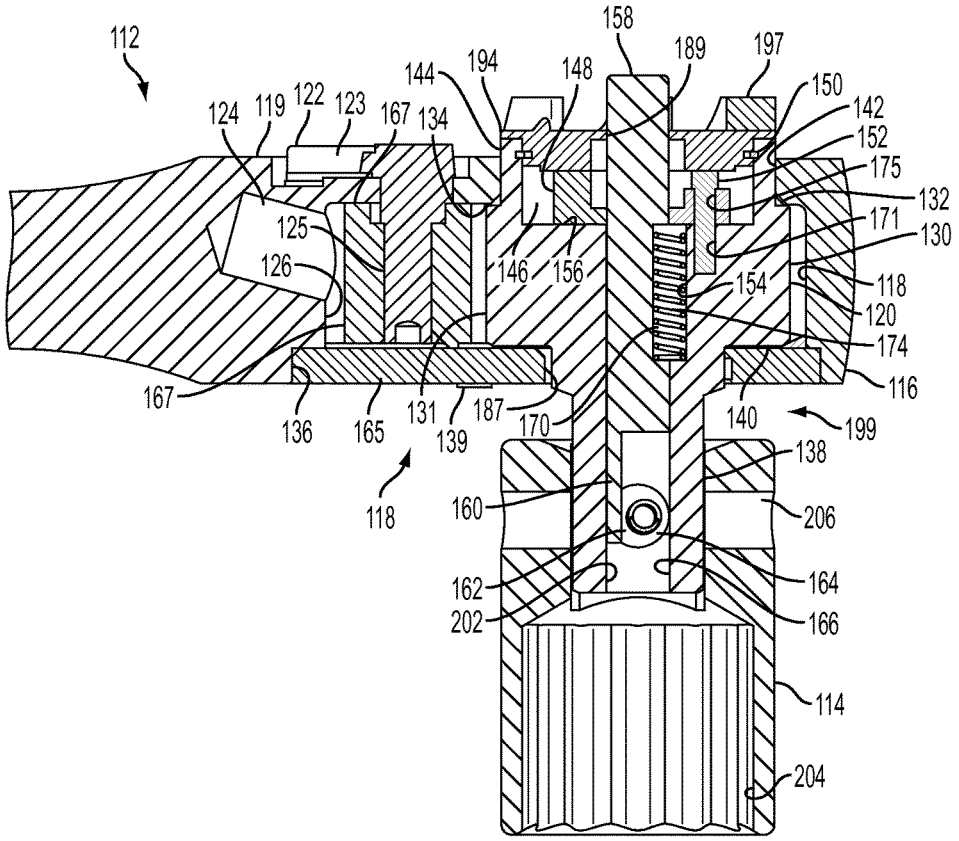
FIG. 2 is a partial sectional view of the ratchet and socket system shown in FIGS. 1A and 1B.

Generally, then, and referring additionally to FIG. 2, teeth 130 are formed around the ratchet wheel's periphery to cooperate with teeth on the front face of the pawl (i.e. the pawl surface that opposes the ratchet wheel's toothed outer circumference). Depending on the pawl's position in chamber 126 with respect to the ratchet wheel teeth and on the direction of torque applied to the handle, the pawl and ratchet wheel cooperate to transfer torque from the wrench handle to the ratchet wheel and drive tang or to allow a ratcheting action between those components.

The ratchet wheel forms a ledge 132 at the top of the ring of teeth 130 that abuts an opposing shoulder 134 of head 116 to retain the ratchet wheel in the head in the upward vertical direction. A cover plate 165 is received in a lower portion 136 of the through-portion of the cavity. The cover plate has a through-hole 187 through which a tang 138 extends downwardly from the ratchet wheel but that has a diameter smaller than the ratchet wheel diameter, thus allowing the cover plate to retain the ratchet wheel in the downward vertical direction by abutment with a lower shoulder 140 of ratchet wheel 120. As shown, cover plate 165 is retained in turn, in the downward direction, by screws 139 (FIG. 1A) that extend through the top of the forging head and thread into threaded holes (not shown) in cover plate 165. Alternatively, the cover plate may be retained in the downward direction by a C-clip (not shown) retained in a groove (not shown) in an opening 136 below the plate.

Figure 4A:
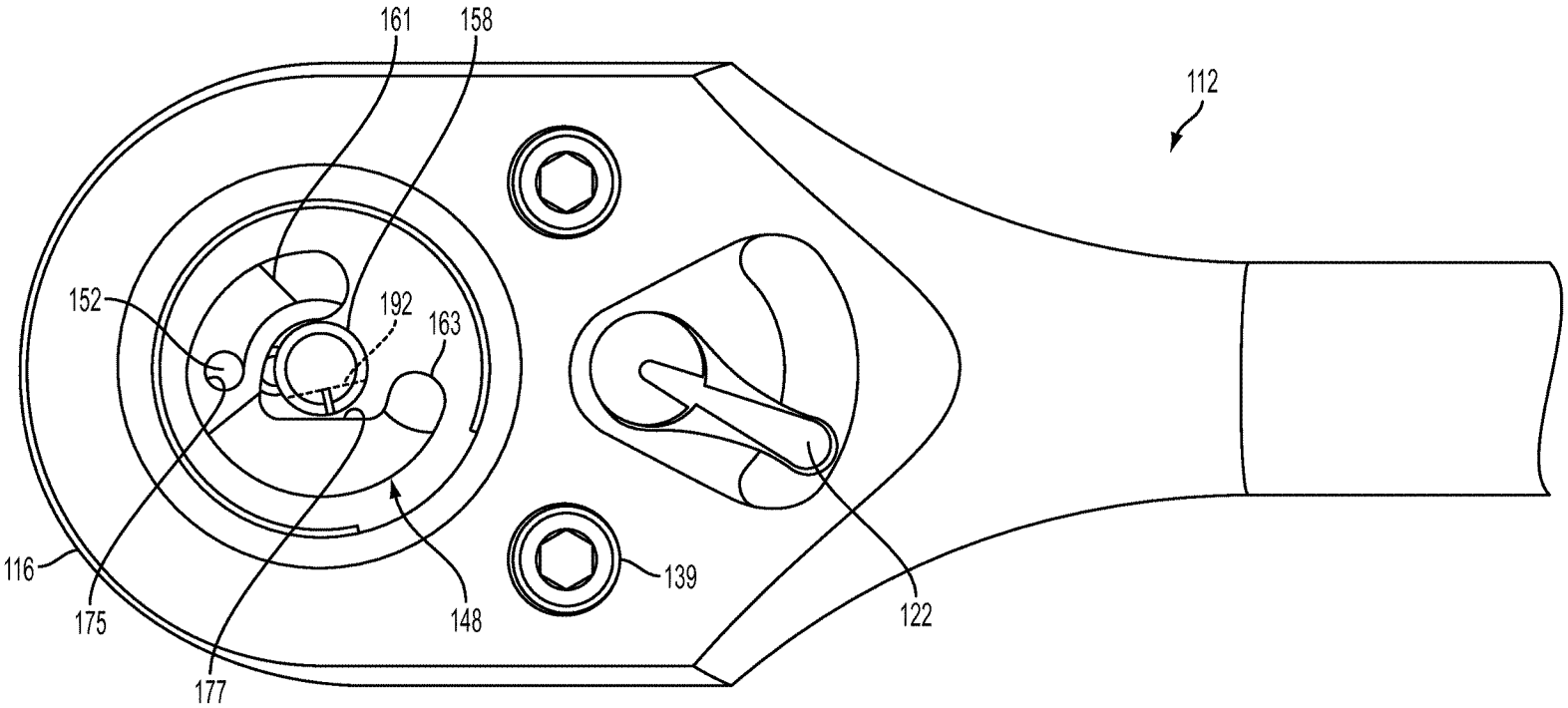
FIGS. 4A and 4B are partial top views of the ratchet and socket system shown in FIGS. 1A and 1B.
Figure 4B:
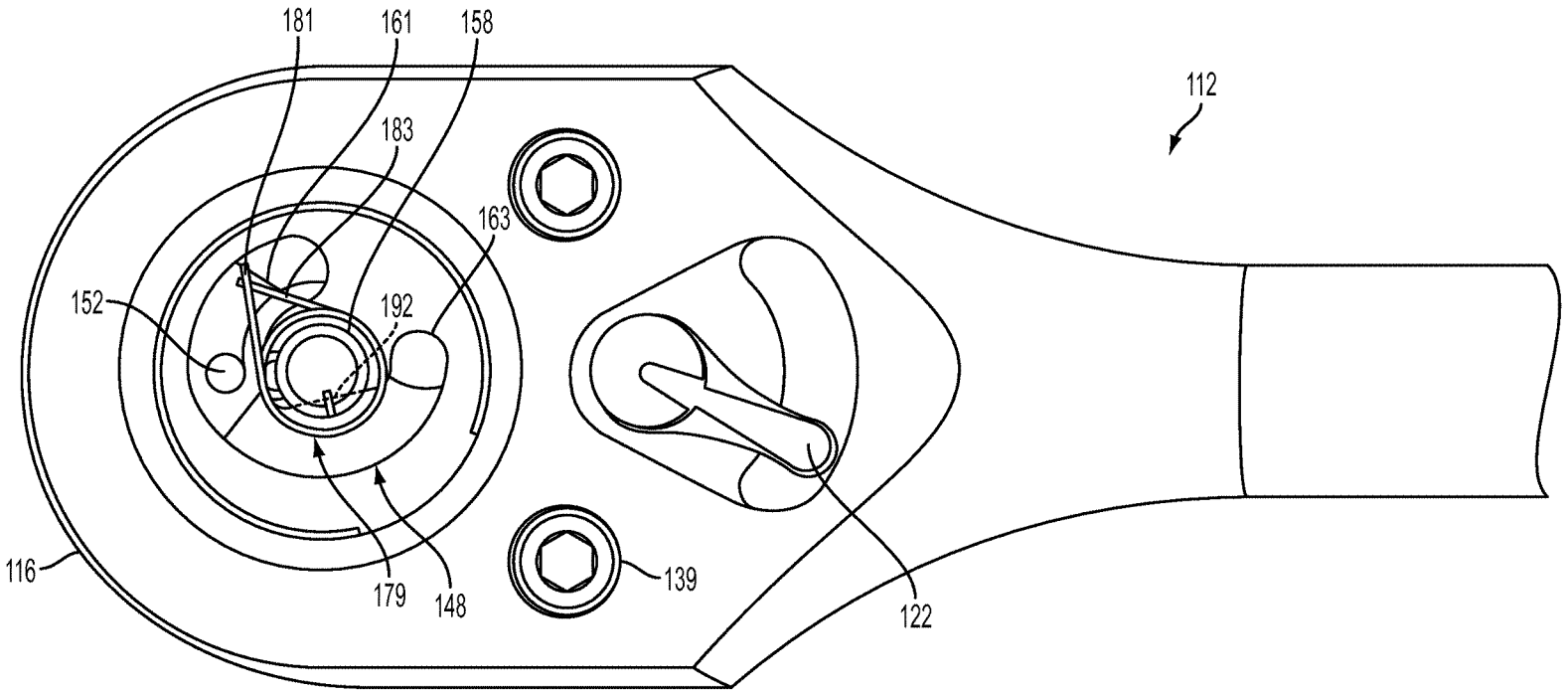

Center hole 142 that opens into cavity 118 receives a neck portion 144 of ratchet wheel 120. Neck portion 144 defines an inner chamber 146 that receives a locking lever 148 therein. As shown in FIGS. 4A and 4B, locking lever 148 is generally semi-circular in shape and pivotably mounted in inner chamber 146 with respect to ratchet wheel 120 by a pin 152, which passes through a hole 175 defined by the locking lever. The chamber's 146 inner diameter and an outer diameter of a cap 194 define opposing grooves that simultaneously receive a C-clip 150, thereby rotatably securing cap 194 to ratchet wheel 120. Additionally, cap 194 retains pin 152 and the locking lever in chamber 146 in the upward axial direction (with respect to the cavity axis), yet allows the locking lever to pivot with respect to the ratchet wheel within the chamber about the pin. A plurality of upwardly depending projections 197 on cap 194 facilitate rotation of the cap by a user, as discussed below.

Ratchet wheel 120 defines a through-hole 166 through which extends an elongated pin 158 which comprises a hand actuatable linkage by which a socket can be released from the ratchet tang. Cap 194 defines a corresponding, concentric through-hole 189 through which pin 158 also extends. A bottom end 160 of pin 158 comprises a flange 160 that extends downward so that flange 160 extends between a generally planar surface 162 of a retaining plunger 164 (described below) and the inner diameter of central bore 166 which also extends through tang 138 of ratchet wheel 120.

Pin 158 defines an axially-directed groove 170 in its outer circumference that opposes a corresponding axial groove 154 in the cylindrical inner diameter of through-hole 166 of ratchet wheel 120. As noted above, the pin's flange 160 is keyed between a flat side surface of plunger 164 and the surface of through-hole 166. Since plunger 164 is received in a countersunk bore 182 in tang 138, this rotationally fixes pin 158 and ratchet wheel 120 with respect to each other. Thus, groove 170 remains opposite the corresponding axial groove 154 in the ratchet wheel during operation of the device. Groove 170 and corresponding axial groove 154 receive a coil spring 174. A bottom end of coil spring 174 abuts both a bottom shoulder of axial groove 154 and a bottom shoulder of groove 170. The opposite, upper, end of spring 174 abuts an upper shoulder of groove 170. Once pin 158 and spring 174 are inserted into through-hole 166, locking lever 148 is placed adjacent the flat bottom surface 156 of chamber 146, and pin 152 is inserted into a corresponding vertical bore 171 found in ratchet wheel 120. Locking lever 148 extends over spring 174, thereby retaining spring 174 and pin 158 in through-hole 166.

Figure 3:
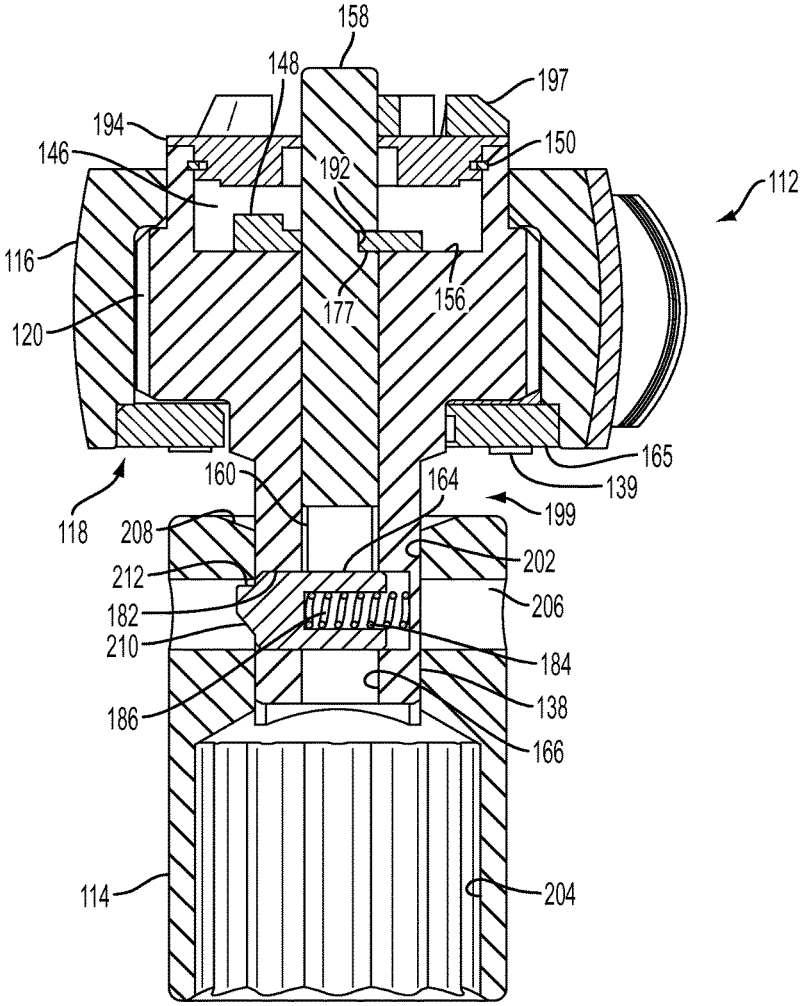
FIG. 3 is a partial sectional view of the ratchet and socket system shown in FIGS. 1A and 1B.
Figure 5A:
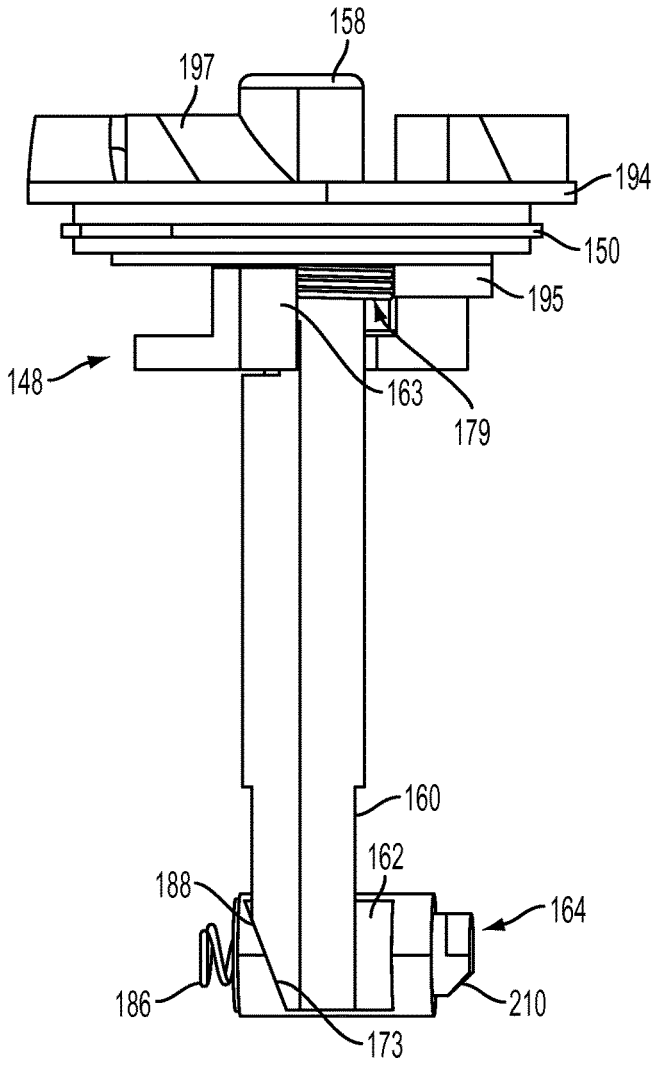
FIGS. 5A and 5B are side elevational views of a portion of the ratchet and socket system shown in FIGS. 1A and 1B.
Figure 5B:
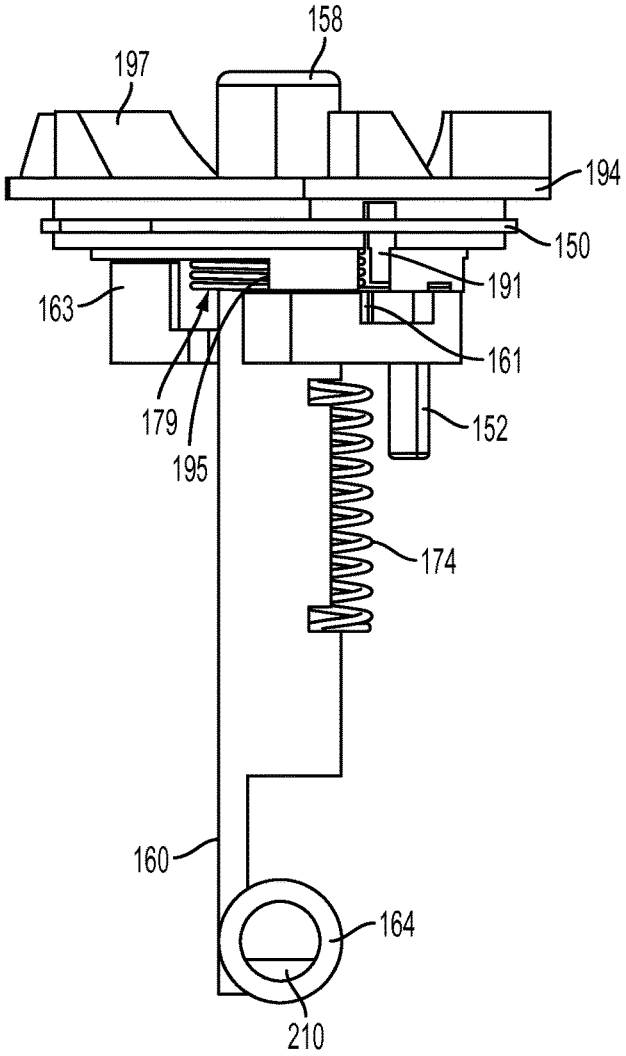

Referring additionally to FIGS. 3, 5A and 5B, plunger 164 is received in a radially extending countersunk bore 182 extending into a side surface of tang 138. Plunger 164 has a countersunk bore 184 that receives a spring 186 that extends between the blind end of bore 182 and the blind end of bore 184, thereby biasing plunger 164 in a direction outward from bore 182. Flange 160, however, includes a side surface 188 that abuts a vertically-extending edge 173 of plunger side surface 162 (FIG. 5A) such that flange 160 prevents plunger 164 from moving out of bore 182, i.e., from moving any further to the left than is shown in FIG. 3. Moreover, the opposing side surface 188 of the flange and edge 173 of the plunger side surface are angled with respect to the axis of hole 166, so that when pin 158 is depressed, flange 160 pushes plunger 164 to the right, in the perspective shown in FIG. 3, against the bias of spring 186.

Referring additionally to FIGS. 4A and 4B, pin 152 is generally cylindrical and disposed in both vertical bore 171 (FIG. 2) of ratchet wheel 120 and hole 175 that passes through locking lever 148. Pin 152 is parallel and adjacent to pin 158, and the ratchet wheel and the pin rotate together about the axis of pin 158 while allowing locking lever 148 to pivot about pin 152 relative to ratchet wheel 120. A locking element or flange 177 extends radially inward from the inner circumferential edge of locking lever 148 and is received in a corresponding radially extending slot 192 in pin 158, thereby preventing pin 158 from moving in through hole 166 in the axial direction (of the cavity axis) with respect to ratchet wheel 120. Thus, in the position shown in FIG. 4B, i.e. the normal locked position, pin 158 is fixed in the axial direction with respect to the ratchet wheel, so that plunger 164 remains biased to its leftmost operative position, as shown in FIG. 3. In this condition, if a socket is secured on the tang by the detent, i.e. plunger 164, an inadvertent blow or other force to the top of pin 158 does not cause the undesired release of the detent or, therefore, the undesired release of the socket.

Figure 6:
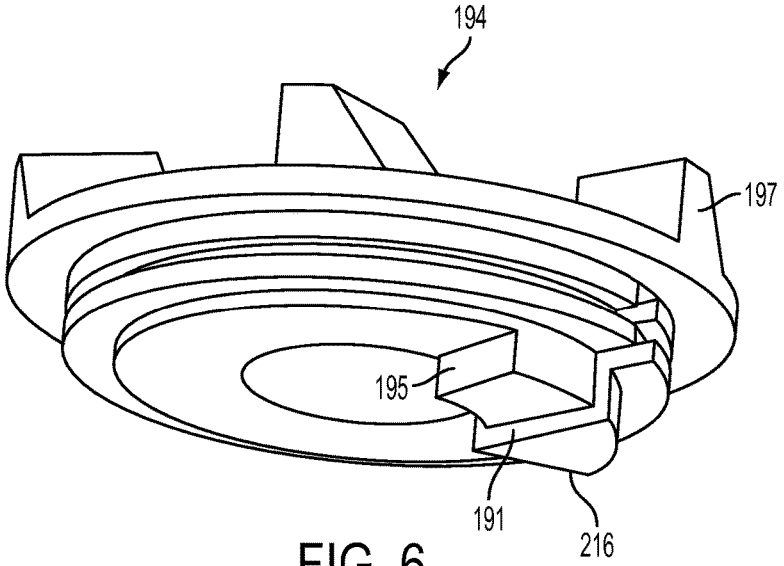
FIG. 6 is a bottom perspective view of a portion of the ratchet and socket system shown in FIGS. 1A and 1B.

A resilient torsion spring 179 is disposed about pin 158 within ratchet wheel chamber 146. A first end 181 of this spring is received in a slot 191 (FIG. 6) in the underside of cap 194, so that this end of the spring is fixed to cap 194. The spring's opposite second end 183 is attached to or abuts an upwardly depending flange 161 on a first end of the locking lever. As shown in FIGS. 1B and 4B, when viewing wrench 110 from above, first end 181 of the spring urges cap 194 in the counter-clockwise direction until a first ledge 216 (FIG. 6) that depends downwardly from the bottom surface of cap 194 abuts the top of pin 152. Second end 183 of the spring urges flange 161 of locking lever 148 radially outwardly so that locking lever 148 pivots about pin 152 relative to pin 152 and the ratchet wheel, thereby causing locking flange 177 to pivot radially inwardly to be received in slot 192 of pin 158. The engagement of locking flange 177 in slot 192 prevents pin 158 from moving axially with respect to the ratchet wheel, thereby preventing pin 158 from releasing a socket that might be retained on the tang. Accordingly, in this position, because end 183 of spring 179 biases against flange 161 of lever 48, thereby pivoting lever 48 about pin 152 until it engages pin 158 which acts as a rotational stop with respect to ratchet wheel 120, spring 179 biases cap 194 rotationally counterclockwise (in the perspective shown in FIG. 4B) with respect to the ratchet wheel. When cap 194 is released, therefore, spring 179 rotates the cap counterclockwise until first ledge 216 abuts pin 152, resulting in the normal rotational position of cap 194 with respect to the ratchet wheel.

To move locking lever 148 from the normal locked position (FIG. 4B) to the unlocked position (FIG. 4A) in which locking flange 177 has disengaged groove 192, a user grasps and rotates cap 194 in the clockwise direction (FIG. 1B) until a first line 193*a* on cap 194 is aligned with a second line 193*b* on the top of pin 158. Assuming ratchet wheel 120 is held in place rotationally, e.g., by a socket secured on a workpiece or in a socket holder or by hand, as the user rotates cap 194, cap 194 begins to rotate with respect to ratchet wheel 120 as well as locking lever 148. This rotation acts against the biasing force of torsion spring 179, and eventually a second ledge 195 (FIG. 6) that depends downwardly from the bottom surface of cap 194 abuts a projection 163 that depends upwardly from a second end of locking lever 148. Continued rotation of cap 194 causes locking lever 148 to pivot about pin 152 from the locked position (FIG. 4B) to the unlocked position (FIG. 4A) in which locking flange 177 is no longer disposed in slot 192 of pin 158.

At this point, the user may push down on pin 158 against the upward biasing force of spring 174, thereby causing the opposing angled side surface 188 of the button's flange 166 and the plunger's vertically extending edge 173 to move with respect to each other, thereby pushing plunger 164 to the left, in the perspective of FIG. 5A, to its position at which the socket can be inserted onto or released from tang 138.

Rotation of cap 194 is in opposition to the force applied by torsion spring 179. Thus, upon release of cap 194, torsion spring 179 biases cap 194 in the counter-clockwise direction back to the normal locked position. Simultaneously, torsion spring 179 also biases locking lever 148 back to the locked position in which locking flange 177 is received in slot 192 of pin 158. In the locked position, a third line 193*c* on the cap is aligned with second line 193*b* on pin 158.

As discussed above, and as indicated in FIGS. 2 and 3, locking lever 148, locking flange 177, resilient element 179, and the engagement between actuator cap 194 and locking lever 148 are located within cavity 118, and more specifically in the illustrated embodiments in the through-portion of that cavity. Being located within the body of ratchet 112, i.e. within a volume bounded by the body's exterior surfaces and the open boundaries of cavity 118 and any other cavity, rather than exterior to that volume, the mechanism is protected from damage and/or unintentional disengagement from the detent linkage. When covered by the actuator, which extends beyond the body boundary to allow user access, the mechanism is not visible from outside the ratchet body, thereby providing a relatively simple, appealing view to the user.

Referring to FIG. 3, socket 114 includes a vertical bore 202 at an upper end of the socket and a second vertical bore 204 at a lower end of the socket. Bore 204 is configured to receive and engage a workpiece, as should be well understood in the art. The particular configuration of the working end of the socket is not, in and of itself, a part of the present invention and is, therefore, not discussed in further detail herein. Upper bore 202 is shaped correspondingly to tang 138 of ratchet wheel 120 so that the upper bore receives the tang. The upper end of socket 114 defines a radially-directed through-bore 206. Upon insertion of the tang into bore 202, a leading edge 208 of the upper surface of socket 114 engages a chamfered surface 210 of plunger 164, thereby pushing plunger 164 to the right (in the perspective of FIG. 3) against the opposing force provided by spring 186. As the tang moves further into bore 202 and plunger 164 aligns with bore 206, the leading end 210 is allowed to move to the left, into bore 206, in accordance with the bias provided by spring 186, as shown in FIG. 3. A shelf 212 at a distal end of plunger 164 is parallel to the radial direction (with respect to the axis of through-hole 156 and pin 158), and parallel to the cylindrical inner diameter surface of bore 206, so that downward force applied to socket 114 causes these opposing surfaces to abut, but does not push plunger 164 to the right. Accordingly, socket 114 is locked in position on the tang. To remove the socket in this embodiment, the user must exercise the multi-step procedure discussed above, first rotating cap 194 to disengage locking flange 177 from pin 158 and thereby allow pin 158 to move relative to the ratchet wheel in the axial direction, and then pushing down on pin 158 to thereby disengage plunger 164 from bore 206, allowing removal of socket 114 from ratchet wheel tang 138.

Referring again to FIG. 5A, the action described above is apparent in the interaction of lower end 160 of pin 158 with planar surface 162 of plunger 164. As shown in FIG. 5A, spring 186 biases plunger 164 to the right (in the perspective of FIG. 5A), so that edge 173 of plunger planer surface or depression 162 engages side surface 188 of flange 160. As apparent in FIG. 5A, the width of planar surface or depression 162 is greater than the width of flange 160 in the direction of the plunger's travel. This difference in width allows the plunger's movement when the socket engages chamfered surface 210 and moves onto the tang, pushing the plunger to the left until the plunger aligns with the socket detent groove. In a further embodiment, however, the width of depression 162 conforms to the width of flange 160, so that the gap between the two on the right of flange 160 as illustrated in FIG. 5A is substantially eliminated, except for example sufficient clearance to allow relative sliding movement between the components. On the side of flange 160 opposite the interface of sides 186 and 188, the right side of flange 160 and the opposing edge of surface or depression 162 are formed in parallel to the left side surfaces 186 and 188, and the angled surface continues in the side of flange 160 for a distance above the plunger to allow the vertical movement of pin 158 to move plunger 164 horizontally through its full range of motion in operation of the device. In this embodiment, plunger 164 does not move independently of pin 158 as the socket moves up onto the tang, and actuation of pin 158 is required both to install the socket onto, and remove the socket from, the drive tang. In this embodiment, chamfered surface 210 may be retained or may be replaced by an edge parallel with the plunger tip's upper edge.

Figure 7:
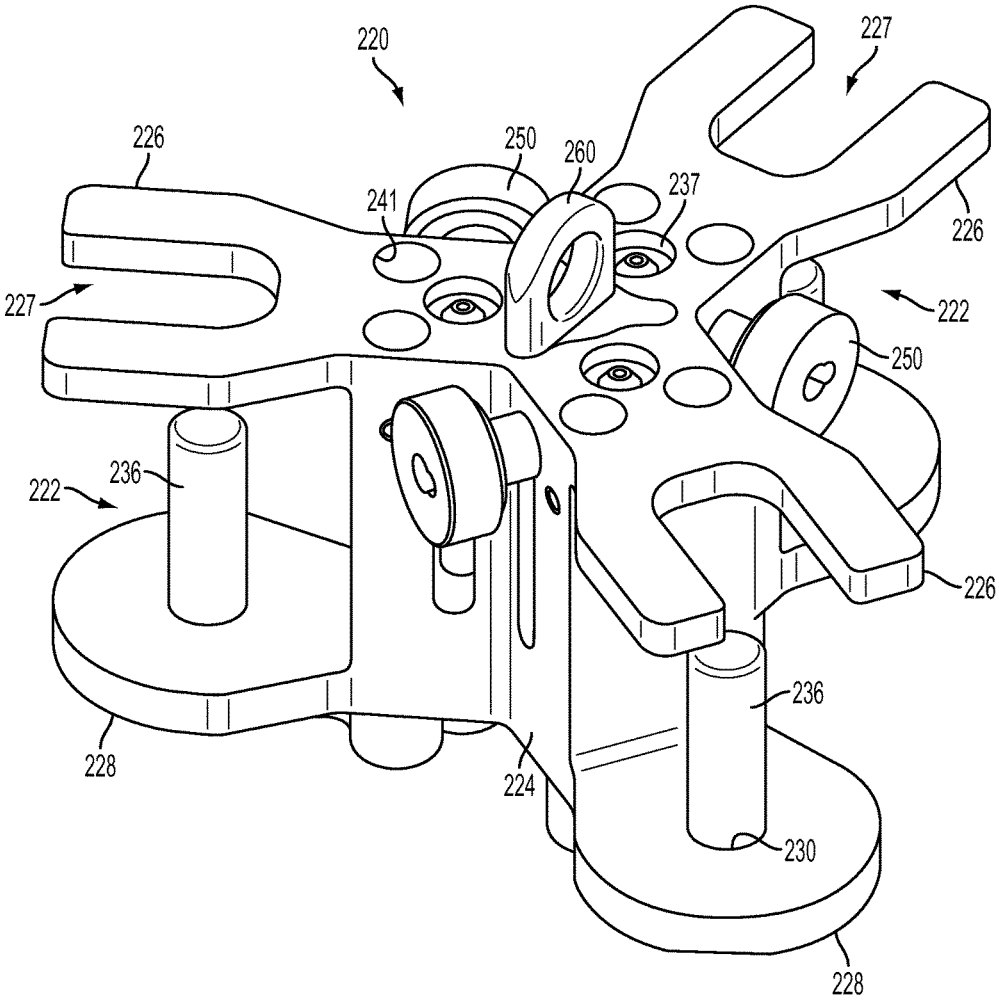
FIG. 7 is a top perspective view of a socket retention mechanism according to an embodiment of the present invention.
Figure 8:
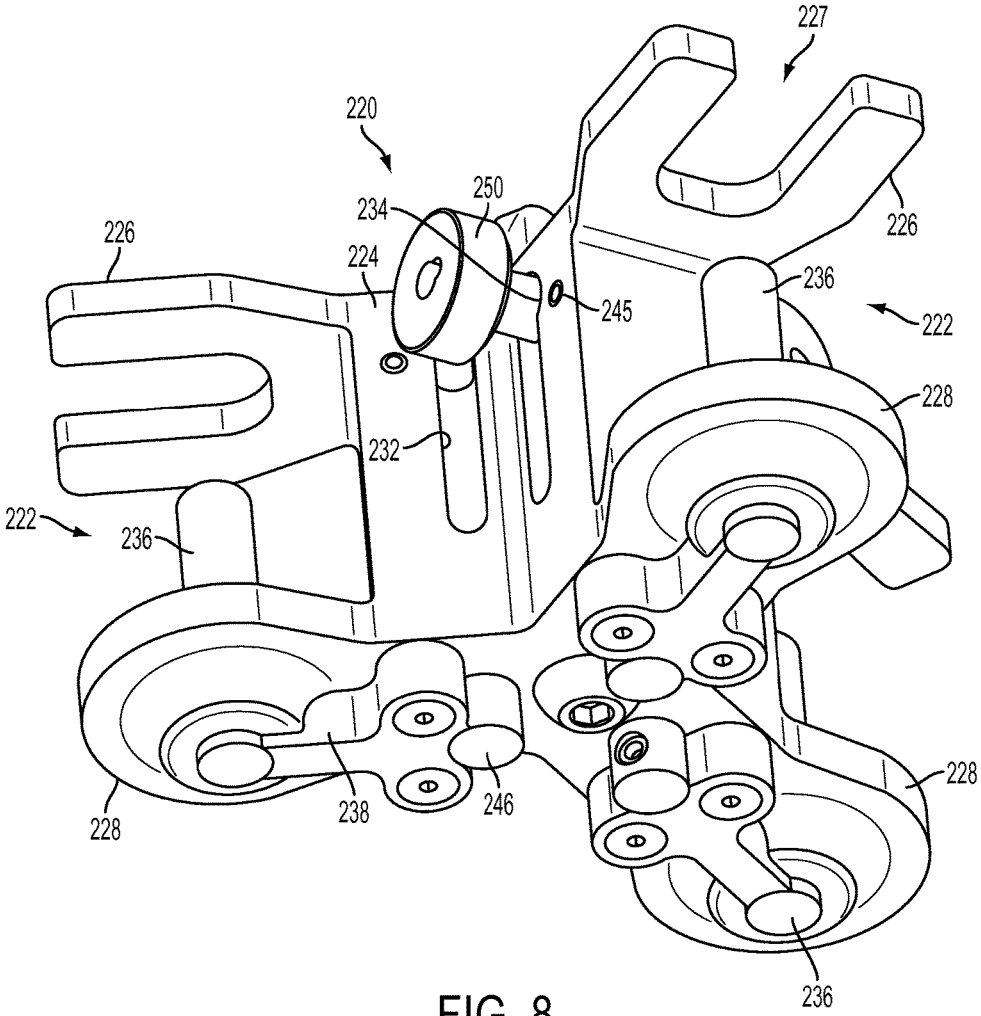
FIG. 8 is a bottom perspective view of the socket retention mechanism shown in FIG. 7.
Figure 11A:
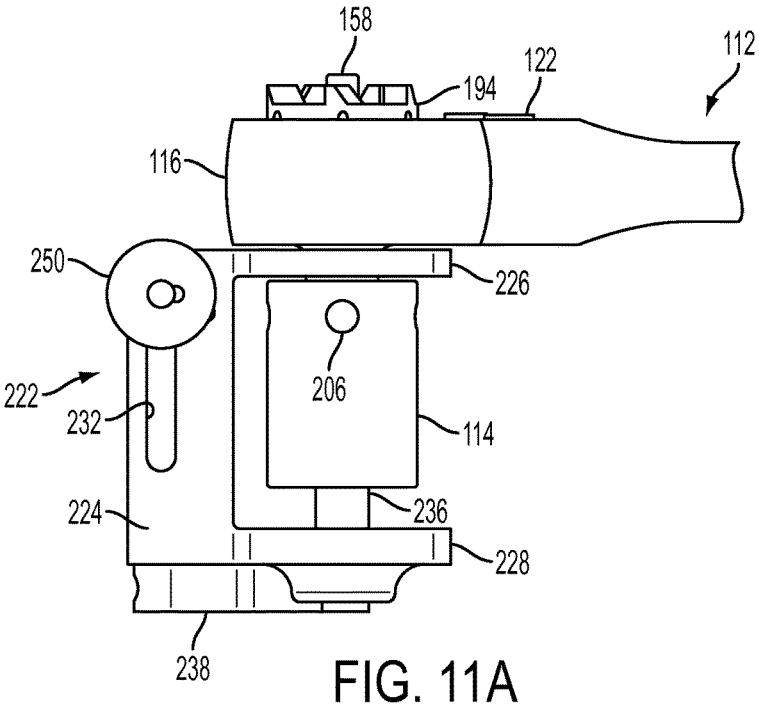
FIGS. 11A and 11B are partial side views of the ratchet and socket system shown in FIGS. 1A and 1B, and the socket retention mechanism shown in FIG. 7.
Figure 11B:
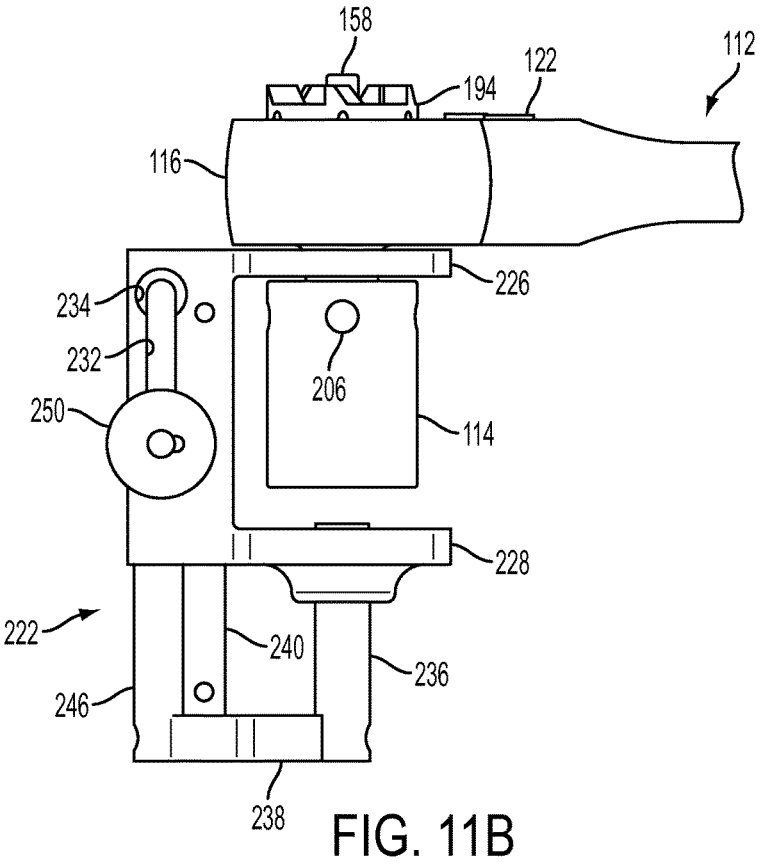

Referring to FIGS. 7 and 8, a socket holder assembly 220 includes a body 224 configured to provide three independent socket holders 222 on a central frame. Alternate socket holder assemblies may include fewer or more socket holders 222. Each socket holder 222 includes an upper flange 226 and a lower flange 228 that are separated by a distance that is at least as great as the height of a socket 114 that is to be received therein (FIGS. 11A and 11B). Upper flange 226 is a socket retainer member that defines a radially extending slot 227 for slidably receiving tang 138 of a corresponding ratchet 112. Lower flange 228 is a socket retainer member that defines an aperture 230 for slidably receiving a retention post 236, which is also a retainer member.

Figure 9A:
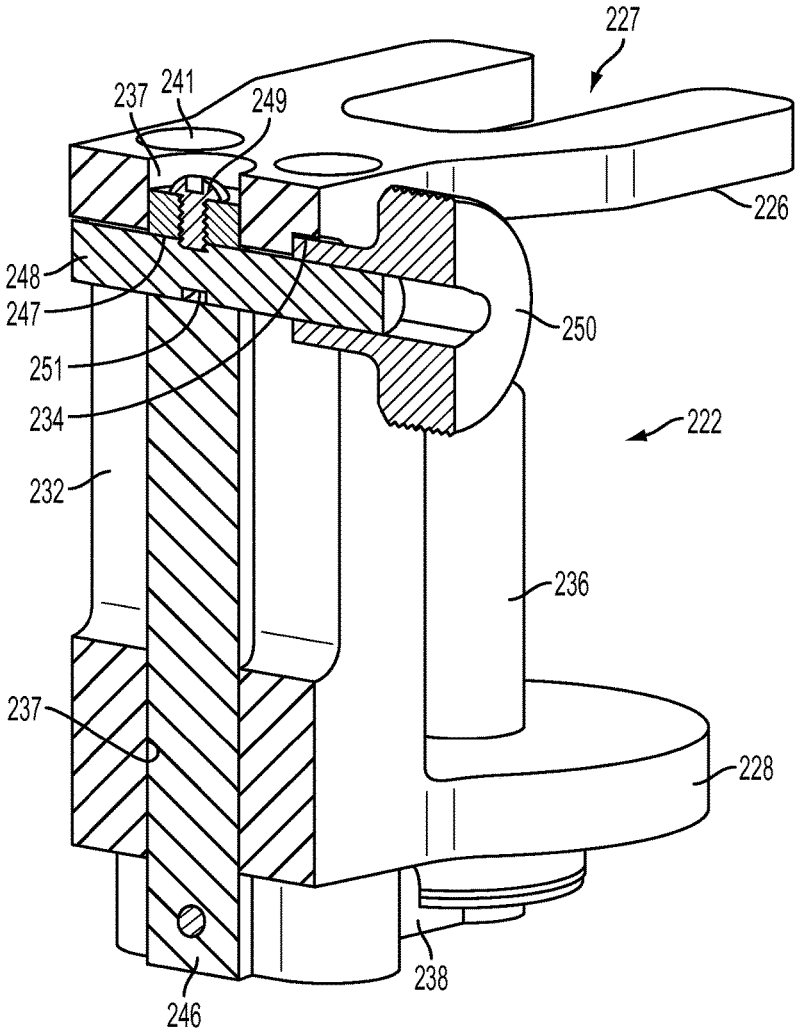
FIGS. 9A and 9B are partial sectional views of the socket retention mechanism shown in FIG. 7.
Figure 9B:
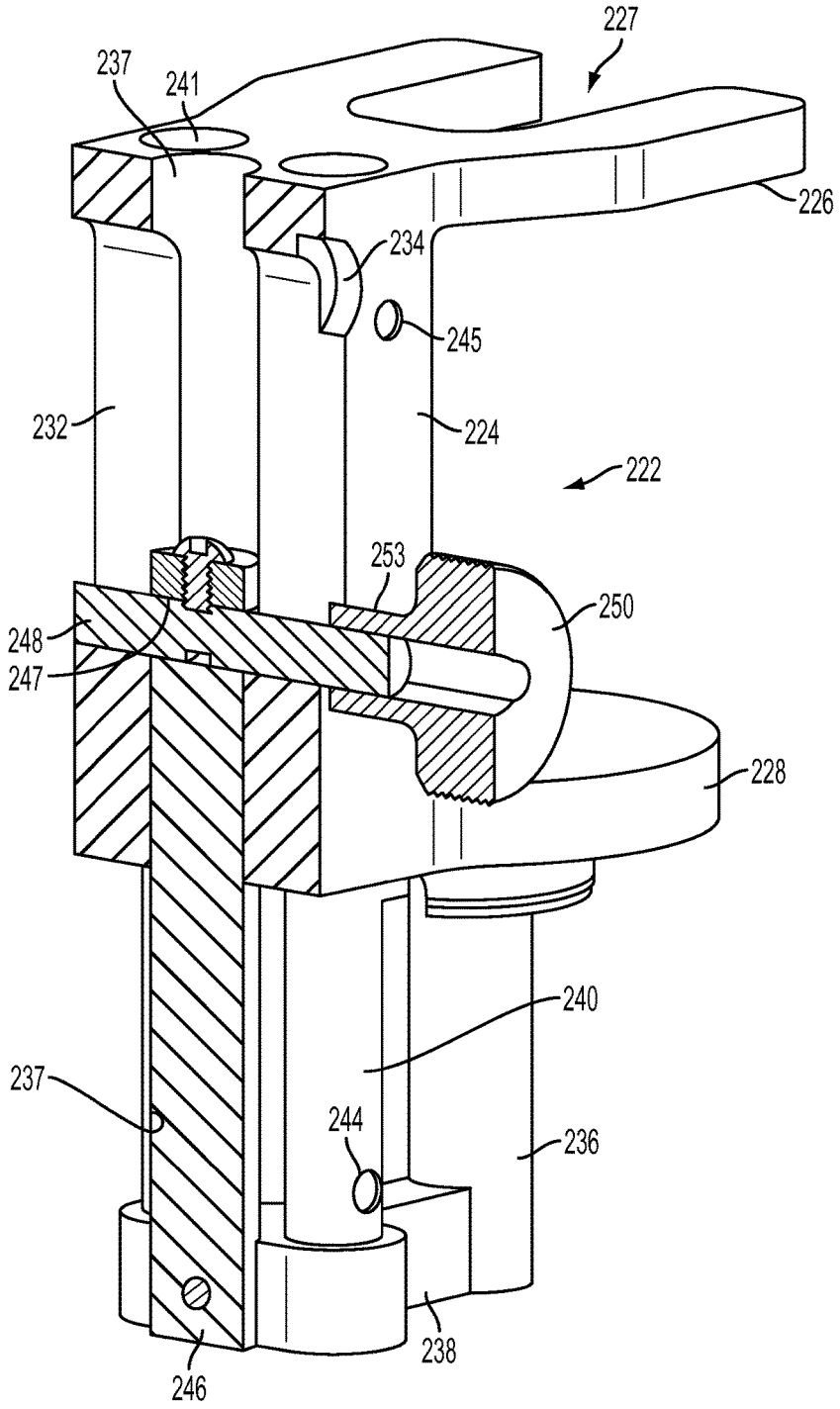
Figure 10:
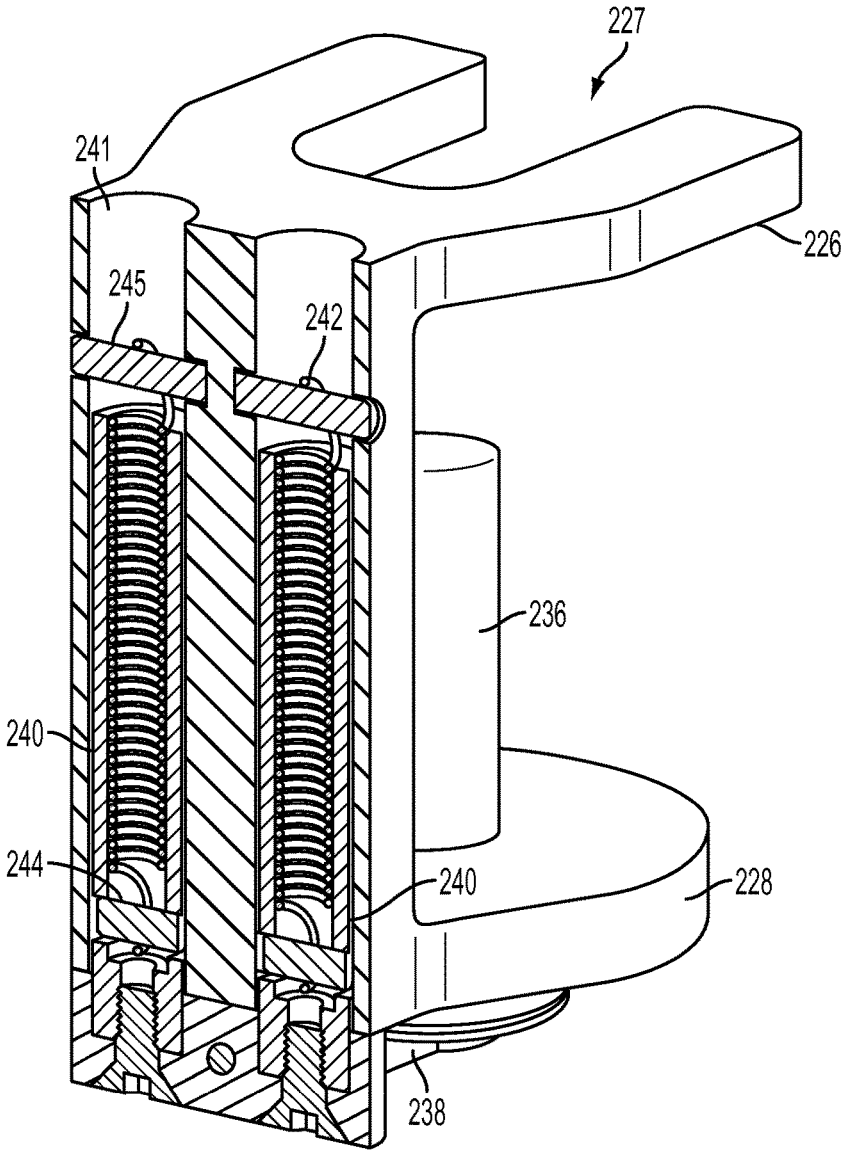
FIG. 10 is a partial sectional view of the socket retention mechanism shown in FIG. 7.

Referring additionally to FIGS. 9A, 9B and 10, the retention mechanism of each socket holder 222 includes a respective base member 238 from which a respective retention post 236 depends upwardly at a first end of the base member, and a respective pair of vertical support members 240 and a respective actuation member 246 that depend upwardly from a second end of base member 238. Actuation member 246 is slidably received in a vertical bore 237 defined by body 224. The socket retention mechanism further includes a horizontal member 248, e.g. an elongated cylindrical rod, that passes through a horizontal bore 247 that is defined in the uppermost end of actuation member 246. A distal end of a threaded fastener 249 is received in an annular groove 251 formed in the outer surface of horizontal member 248 so that horizontal member 248 is longitudinally secured within bore 247. A vertical slot 232 passes through the body 224 of the socket holder and intersects bore 237 along a majority of its length. The upper end of vertical slot 232 includes a recess 234 that is configured to selectively receive a base portion 253 of a knob 250 that is reciprocally disposed on an end of horizontal member 248. Knob 250 is axially slidable along horizontal member 248 to a limited extent so that the (smaller diameter) base portion of knob 250 may be selectively inserted and removed from the recess, as discussed in greater detail below. Although not illustrated in the figures, knob 50 defines an enlarged central bore portion at the inner diameter of the base portion that received the end of horizontal member 248, and the end of horizontal member 248 defines a groove, thereby defining opposing shoulders of the end of the knob base portion and the horizontal member end between which is disposed a spring that biases knob 50 to the left (in the perspective of FIGS. 9A and 9B) with respect to horizontal member 248.

Knob 250 is movable between a socket retention position (FIG. 9A) and a socket release position (FIG. 9B). In the socket retention position, base portion 253 of knob 250 is received in recess 234 at the top of vertical slot 232. In this position, retention post 236 is in its uppermost position with respect to base member 238 and lower flange 228 and, when the retention post it is received in a central bore of a corresponding socket 114 (FIG. 11A), thereby retaining the socket in the socket holder in the lateral direction. Referring to FIG. 11A, when a socket 114 is received in a socket holder 222, post 236 retains the socket laterally with respect to the axis of the cylindrical volume or space occupied by the socket, while lower flange 228 restricts the socket in the lower axial direction and upper flange 226 restricts the socket in the upper axial direction. As should be understood in this art, sockets 114 have a predetermined minimum diameter (with respect to the socket's axis) and a predetermined maximum height, depending on a predetermined range of operative socket sizes. Post 236 locates the socket laterally, thereby defining the cylindrical volume occupied by the socket in the holder. The post does not necessarily tightly fit within the socket, such that the socket retention space encompasses some degree of lateral movement by the socket. The holder is constructed, as illustrated in FIGS. 9A-11B, to accommodate these volumes corresponding to the predetermined range of socket sizes. Thus, the offset between upper and lower flanges 226 and 228 in the axial direction is sufficient to accommodate the socket within the predetermined range of sizes having the maximum height (i.e. dimension in the axial direction), and the longitudinal length of post 236 is also sufficient to extend into the central bore of any socket within the range of sizes and laterally retain the socket in the holder. As should also be understood, the sockets within the predetermined range will have a predetermined minimum diameter (transverse to the socket axis) of the drive portion of the socket, among the socket sizes in the range. Lower flange 228 can be configured in various shapes but has at least one width in the dimension of that diameter (i.e. transverse to the socket/retaining volume axis) that is at least slightly larger than the smallest drive portion internal diameter of the sockets within the range that holder 222 is designed to secure. Upper flange 226 may also have various configurations, but in the presently-described embodiment it will generally have at least one dimension transverse to the socket longitudinal axis that extends into a first perimeter (in a plane transverse to the socket/retaining volume axis) that is centered on the socket/retaining volume axis and is defined by the smallest outer diameter of the sockets within the range that holder 222 is designed to secure. The upper flange does not extend, however, into a second perimeter (in the same transverse plane and centered on the same axis as the first perimeter) that is defined by the largest ratchet tang-receiving hole in the top of the sockets within the predetermined socket size range. In the embodiment illustrated in FIGS. 7-11B, the upper flange is fork-shaped, so that the two prongs of the fork extend into the first, outer perimeter but avoid (via slot 227) the second, inner perimeter, thereby allowing the ratchet tang access to the socket's tang-receiving bore when the socket is secured in the retaining volume.

Post 236 has a height sufficient to extend into the internal drive apertures of, and so as to laterally secure, all sockets within the predetermined size range but that is sufficiently limited that the post does not interfere with insertion of the ratchet tang into the tang-receiving hole at the top of the smallest-height socket in predetermined socket size range. As will be apparent, therefore, the dimensions of the components of socket holder 222 may be configured to accommodate one or more sockets within a predetermined range of socket sizes, and the socket holders 222 of a given socket holder assembly 220 (FIG. 8) may be all configured to secure sockets of the same predetermined size range or to secure sockets of predetermined different size ranges, or even to secure sockets of respectively individual single sizes, as will be apparent from the present disclosure.

To remove a socket 114 from a given socket holder 222, the user inserts tang 138 of ratchet 112 (FIG. 1) downward through slot 227 between the forks of upper flange 226 and into the socket through the socket's tang-receiving bore, so that plunger 164 retracts inward into bore 182 in response to the edge of the socket's tang-receiving bore and then moves radially outward to engage transverse socket bore 206 (FIG. 3). The user then pulls outwardly (with respect to the axis of member 248) on knob 250 until knob base portion 253 is removed from recess 234. The user pulls knob 250 downwardly (in the perspective of FIGS. 11A and 11B) with respect to the socket holder, thereby urging retention post 236 downwardly until its uppermost portion is flush with the top surface of bottom flange 228. At this point, the corresponding socket may be slid laterally outwardly from between upper flange 226 and lower flange 228 of socket holder 222. Note, that the ratchet tang slides out of the open end of slot 227 between the forks of upper flange 226. Retention post 236 is then allowed to return to the socket retention position shown in FIG. 8 by releasing downward force on knob 250. As shown in FIG. 10, each vertical support member 240 includes a spring 242 that is secured to its corresponding vertical support member 240 at its bottom end by a pin 244 and at its upper end to body 224 of the socket holder by a pin 245. Springs 242 exert upward force on the retention mechanism, causing the retention mechanism to return from the position shown in FIG. 11B to the socket retention position as shown in FIG. 11A.

To return the socket from the ratchet to socket holder 222, the user moves retention post 236 to the socket release position shown in FIG. 11B, as discussed above. The user then aligns ratchet 112 with the socket holder so that tang 138 is aligned with slot 227 of upper flange 226, and upper flange 226 is positioned in gap 199 between the bottom of wrench head 116 and top of socket 114. The socket is then moved into socket holder 222 between the upper and lower flanges until the central bore 204 of the socket is vertically aligned with aperture 230 (FIG. 7) of bottom flange 228 and, therefore, retention post 236. Retention post 236 is allowed to return to the socket retention position shown in FIG. 11A. The user conducts the dual-step release procedure discussed above to allow removal of tang 138 from the socket, thereby leaving the socket securely in place in socket holder 222.

Figure 12A:
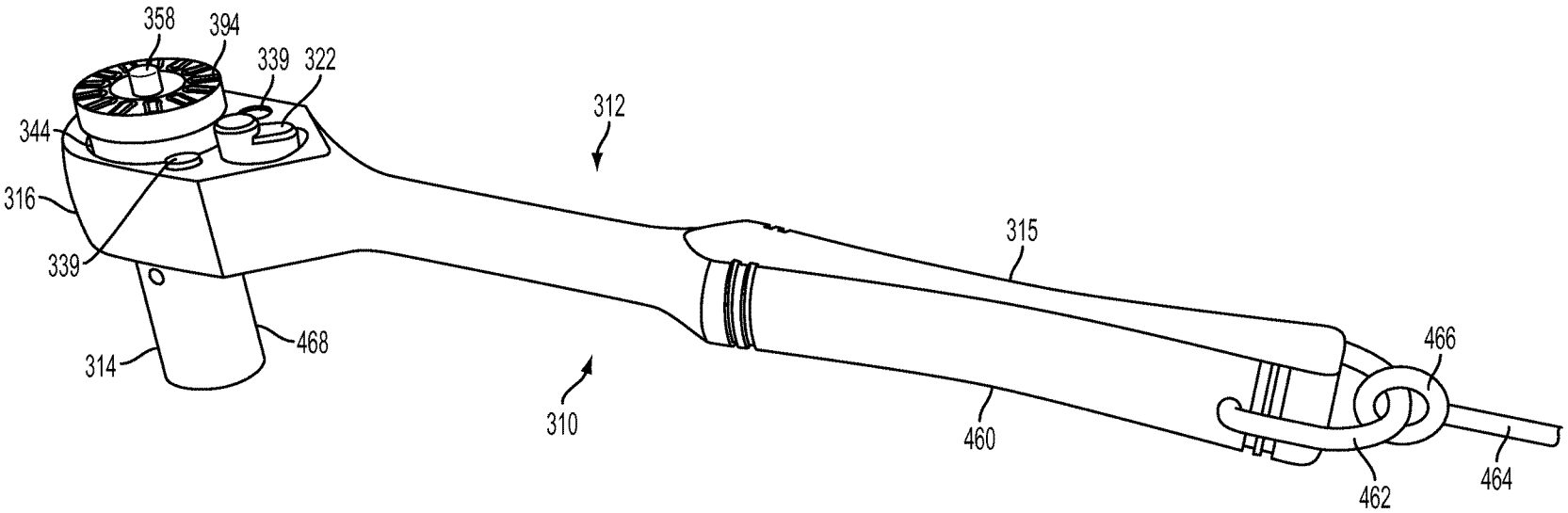
FIGS. 12A and 12B are perspective and partial perspective views of a ratchet and socket system according to an embodiment of the present invention.
Figure 12B:
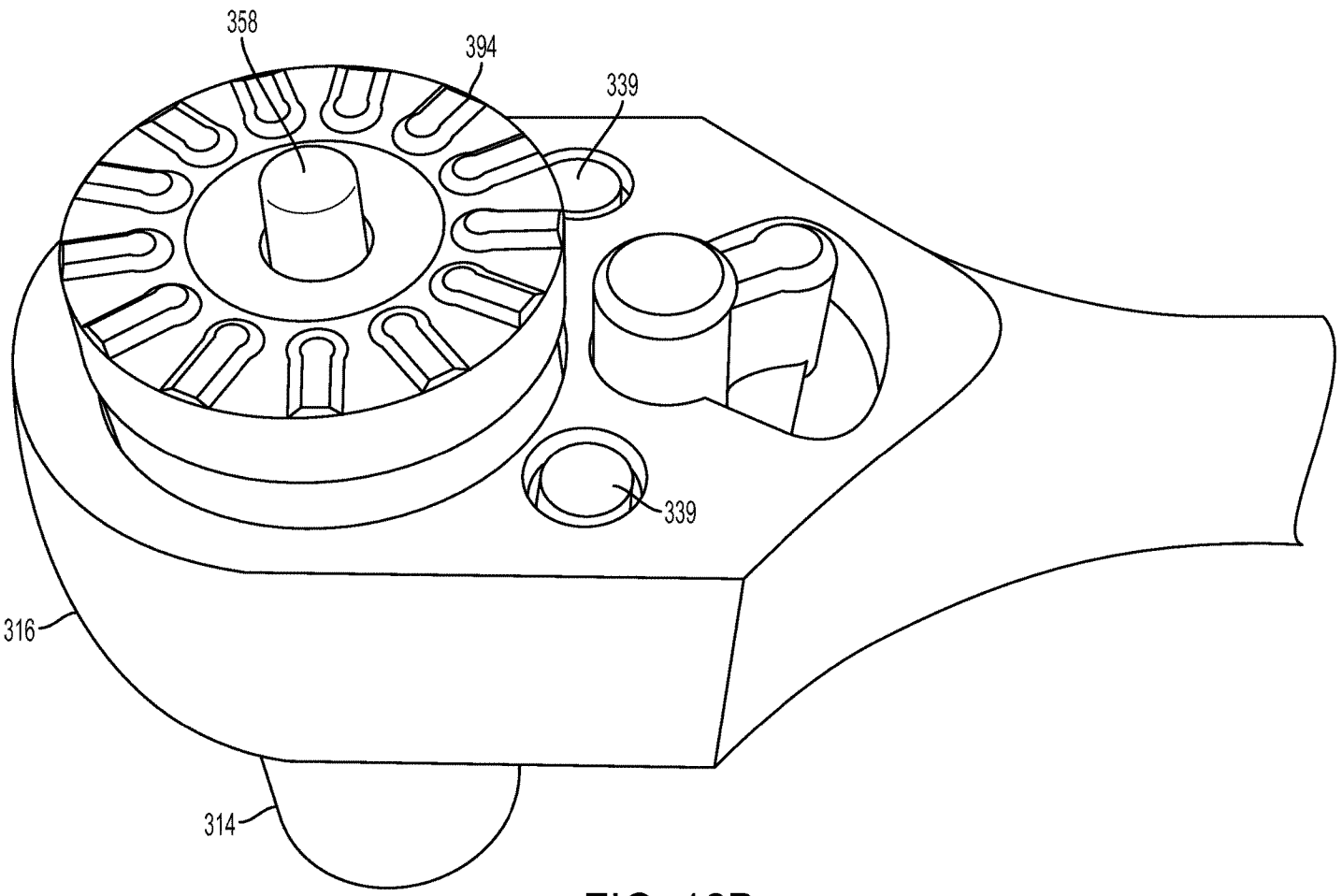

Referring now to FIGS. 12A and 12B, another embodiment of a ratchet and socket assembly 310 includes a ratchet 312 to which is attached a socket 314. Ratchet 312 has a body handle portion 315 attached to and extending from a head portion 316. Body portion 315 defines a longitudinal axis in the same manner as described above with respect to the handle of the embodiment of FIGS. 1A and 1B. A through cavity 318 (FIG. 13) is formed in head 316 from the top to the bottom of the head. A ratchet wheel 320 is disposed in the through cavity. A pawl (not shown) is disposed in the through cavity between the ratchet wheel and the handle. Alternatively, the portion of the forging between the handle and the round part of the head may be considered a web between these two body forging components, and in that event the pawl may be considered to be received in a cavity or chamber in the web that opens to the through cavity and opens also to the ambient environment through the top of the web. A reversing lever 322 is disposed in the through cavity (or the chamber), proximate handle 314 and juxtapositioned above the pawl. The reversing lever extends down and into engagement with the pawl so that rotation of the reversing lever moves the pawl between either of two operative lateral positions, as described below. A spring-loaded pusher (not shown) is carried in a blind bore 324 (FIG. 13) in the web portion of the ratchet forging at which the head intersects the handle. A spring is disposed in the blind bore, urging the pusher to engage a pocket or depression in the pawl's rearward face. The pusher may have a conical tip that is received in this rear pawl pocket. The pawl pocket may have a ridge in the center so that as the reversing lever moves the pawl from one lateral position to another in the pawl portion 326 of the through cavity, or chamber 326, the pusher helps retain the pawl in the respective lateral end position. In a further embodiment, a pawl/reversing lever/pawl cavity arrangement as in the embodiment of FIGS. 1A and 1B may be utilized. Moreover, and as discussed above, various pawl and lever configurations are well known and understood and may be used in various embodiments of the present invention, and these structures, therefore, are not discussed in further detail herein. Examples of pawl and ratchet configurations, which may be utilized with ratchet arrangements encompassed by this disclosure, are described in the above-referenced U.S. Pat. Nos. 5,178,047; 5,199,330; 5,199,335; 5,553,427; 5,782,147; 6,134,991; 6,161,454; 6,230,591; 6,260,448; 6,629,477; 6,711,973; 6,868,759; 6,918,323; 6,971,287; and 6,988,429.

Figure 13:
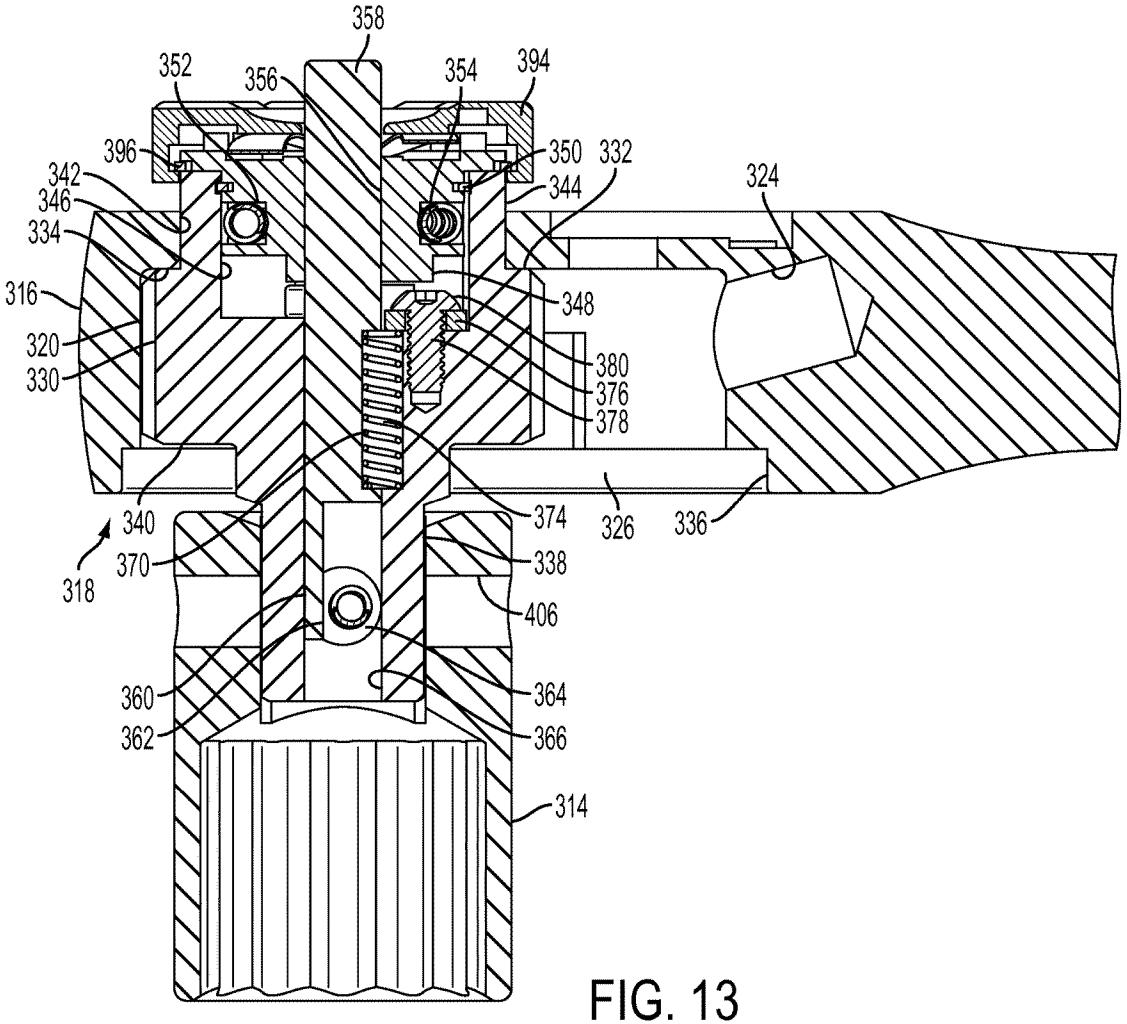
FIG. 13 is a partial sectional view of the ratchet and socket system shown in FIGS. 12A and 12B.

Referring to FIG. 13, teeth 330 are formed around the ratchet wheel's periphery to cooperate with teeth on the front face of the pawl (i.e. the pawl surface that opposes the ratchet wheel's toothed outer circumference). Depending on the pawl's lateral position in chamber 326 and on the direction of torque applied to the handle, the pawl and ratchet wheel cooperate to transfer torque from the wrench handle to the ratchet wheel or to allow a ratcheting action between those components. A ledge 332 is formed at the top of the ring of teeth that abuts a shoulder 334 of head 316 to retain the ratchet wheel in the head in the upward direction. A cover plate (not shown) is received in a lower portion 336 of the through cavity. The cover plate has a through-hole through which extends a tang 338 extending downwardly from the ratchet wheel but that has a diameter smaller than the ratchet wheel diameter, thus allowing the cover plate to retain the ratchet wheel in the downward direction by abutment with a lower shoulder 340 of ratchet wheel 320. The ratchet wheel may be retained in turn, in the downward direction by a C-clip (not shown) retained in a groove (not shown) in opening 336 below the plate or by screws 339 that extend through the top of the forging head and thread into threaded holes (not shown) in the cover plate.

The through-hole defines a center hole 342 through which extends a neck portion 344 of ratchet wheel 320. Neck portion 344 defines an inner chamber 346 that receives a bushing 348 therein. Bushing 348 is generally cylindrical at an outer diameter thereof that opposes a generally cylindrical inner diameter of chamber 346. The chamber's inner diameter and the bushing's outer diameter define opposing grooves that simultaneously receive a C-clip 350 that thereby retains the bushing in the chamber in the axial direction but allows the bushing to rotate with respect to the ratchet wheel within the chamber about the chamber's and bushing's common axis. Bushing 348 defines a circumferential groove 352 in which is disposed a coil spring 354. One end of spring 354 abuts a surface of bushing 348, while the other abuts a pin attached to ratchet wheel 320 that extends radially inward from the inner diameter of chamber 346 into circumferential groove 352. The circumferential groove does not extend entirely about the bushing, and in a normal state, the pin abuts an end surface of groove 352 so that the pin is disposed between the groove's end surface and the second end of spring 354. In this normal state, spring 354 is in (partial) compression, so that the spring biases the bushing rotationally within chamber 346 so that the flush end of chamber 352 abuts the pin (not shown), thereby establishing a stop position.

Bushing 348 defines a through-hole 356 through which extends an elongated pin 358. A bottom end 360 of pin 358 comprises a flange that extends downward so that flange 360 extends between a generally planar surface 362 of a retaining plunger 364 (described below) and the inner diameter of a central bore 366 extending through tang 338 and ratchet wheel 320 from chamber 346.

The outer circumferential surface of pin 358 is smooth about its circumference that opposes the bushing's inner diameter, and there is sufficient clearance between the two surfaces to allow relative rotation between the bushing and the pin. Because spring 354 normally biases the bushing so that the end of groove 352 abuts the pin (not shown) fixed to the ratchet wheel, pin 358 is in a corresponding normal rotational position as shown in FIG. 13.

Pin 358 defines an axially-directed groove 370 in its outer circumference that opposes a corresponding axial groove in the cylindrical inner diameter of through-hole 366 of ratchet wheel 320. As noted above, the pin's flange 360 is keyed between a flat side surface of plunger 364 and the surface of through-hole 356. Since plunger 364 is received in a countersunk bore 382 in tang 338, this rotationally fixes pin 358 and ratchet wheel 320 with respect to each other. Thus, groove 370 remains opposite the corresponding axial groove in the ratchet wheel during operation of the device. Groove 370 and the corresponding axial groove receive a coil spring 374. A bottom end of coil spring 374 abuts both a bottom shoulder end of the slot and a bottom shoulder surface of groove 370. The opposite, upper, end of spring 374 abuts an upper shoulder of groove 370. Once pin 358 and spring 374 are inserted into through-hole 366, a washer 376 is placed about a threaded hole 378 in the countersunk surface of chamber 346, and a threaded screw 380 is threaded into and secured into hole 378. Washer 376 extends over spring 374, thereby retaining spring 374, and pin 358 in through-hole 366.

Figure 14:
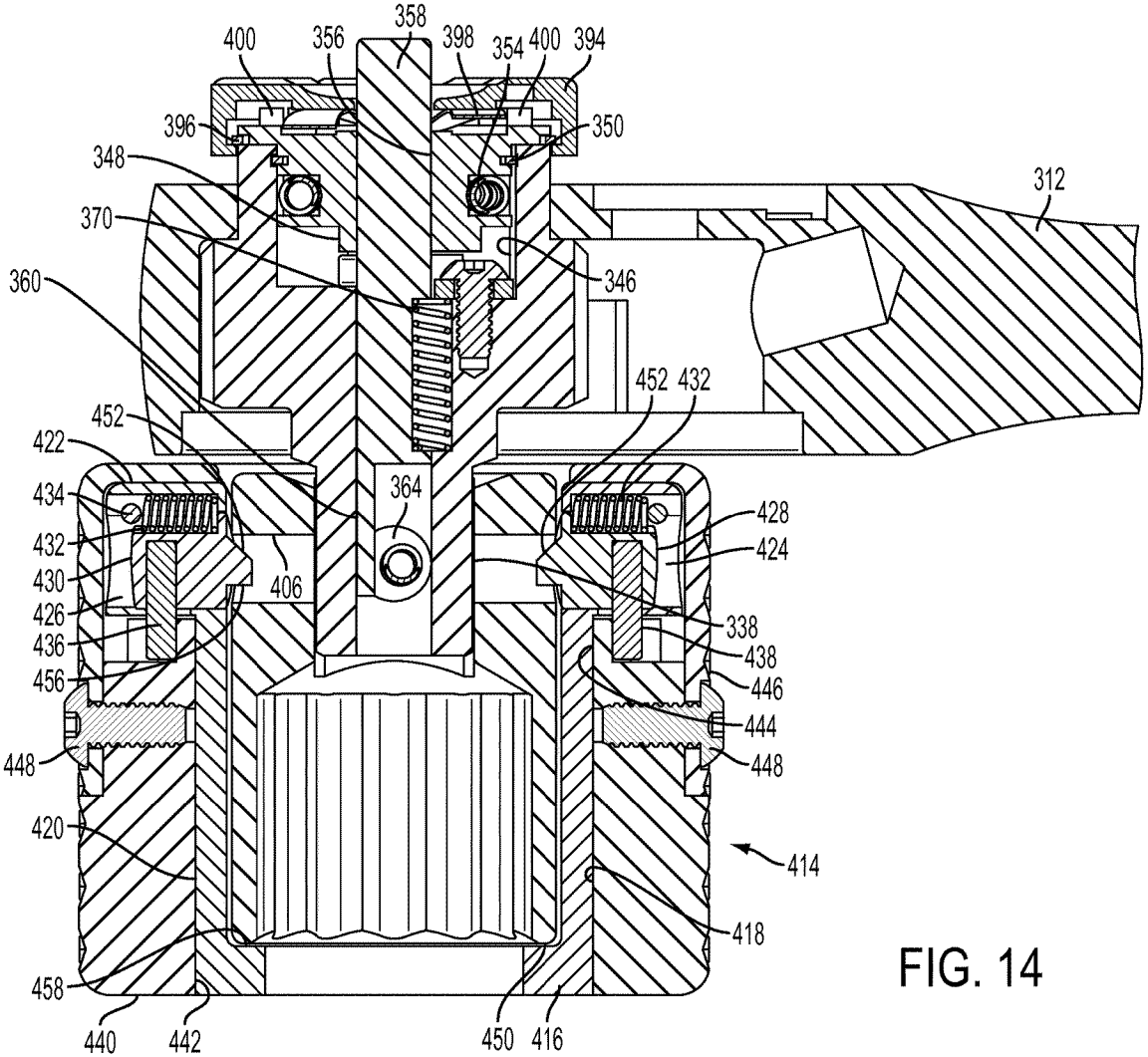
FIG. 14 is a partial sectional view of the ratchet and socket shown in FIGS. 12A and 12B, and a socket retention mechanism according to an embodiment of the present invention.
Figure 16:
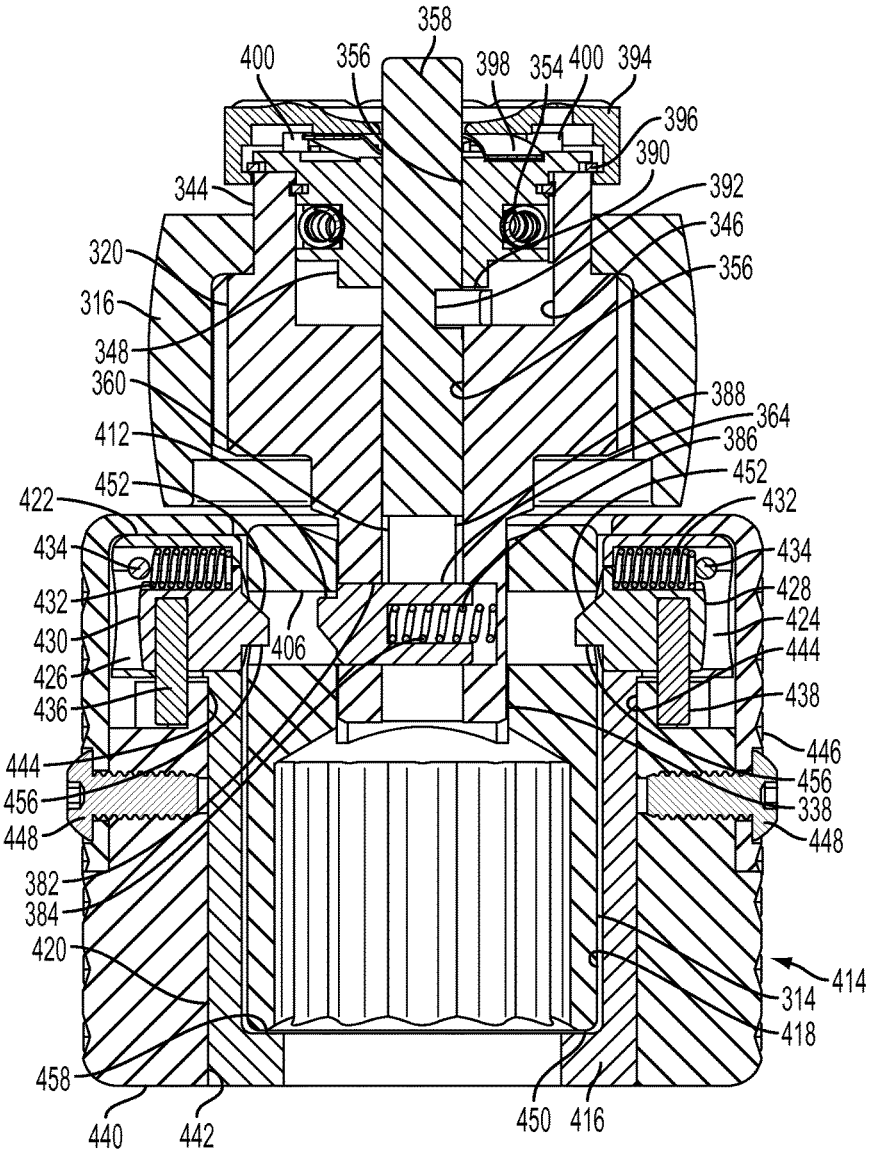
FIG. 16 is a partial sectional view of the ratchet, socket, and socket retention mechanism shown in FIG. 14.

Referring to FIGS. 14 and 16, plunger 364 is received in a radially extending countersunk bore 382 extending into a side surface of tang 338. Plunger 364 has a countersunk bore 384 that receives a spring 386 that extends between the blind end of bore 382 and the blind end of bore 384, thereby biasing plunger 364 in a direction outward from bore 382, to the left as shown in FIG. 16. Flange 360, however, on its side 388, abuts a vertically-extending edge of plunger side surface 362 (FIG. 13) such that flange 360 prevents plunger 364 from moving out of bore 382, i.e., from moving any further to the left than is shown in FIG. 16. Moreover, the opposing surfaces of edge 388 and the plunger side surface (not shown) are angled with respect to the axis of hole 366 (FIG. 13), so that when pin 358 is depressed, flange 360 pushes plunger 364 to the right, in the perspective shown in FIG. 16.

A generally cylindrical pin (not shown) is disposed in chamber 346, parallel and adjacent to pin 358 and is partially received in a corresponding hole in ratchet wheel 320, so that the pin is rotatable in the hole with respect to the ratchet wheel but so that the ratchet wheel and the pin rotate together about the axis of pin 358 with respect to the bushing. A flange 390 extends radially outward from this pin and is received in a corresponding slot 392 in pin 358, thereby preventing pin 358 from moving in the axial direction with respect to bushing 348 and ratchet wheel 320, in through-hole 356. Thus, in the position shown in FIGS. 13, 14, and 16, i.e. the normal position, pin 358 is fixed in the axial direction with respect to the ratchet wheel, so that plunger 364 remains biased toward the left, as shown in FIG. 16. A resilient spring member (not shown) extends in a semicircular arc in chamber 346 about pin 358. One end of this spring is attached to a pin (not shown) that is received in a slot in the bushing, so that this end of the spring is fixed to bushing 348. The spring's opposite end is attached to or abuts flange 390. Since the pin from which flange 390 extends travels with ratchet wheel, relative rotation between the bushing 348 and ratchet wheel 320, in the relative rotational direction opposite the force applied by spring 354, causes the semicircular spring to compress and apply force to flange 390 that causes the flange's pin to rotate in its hole in the ratchet wheel. As the pin rotates with respect to its axis, flange 390 moves out of slot 392, thereby allowing pin 358 to move axially in hole 356, with respect to the bushing and the ratchet wheel.

A cap 394 is disposed about the upper end of bushing 348 and is retained on the bushing by a C-clip 396 received in opposing grooves of the bushing's outer diameter and the cap's inner diameter. A leaf spring 398 disposed between the cap and the bushing biases the cap upward, away from the bushing's upper surface. In this condition, as shown in Figure's 14 and 16, cap 394 may rotate freely with respect to bushing 348. An upper surface of cap 394, however, defines a plurality of holes (not shown) disposed opposite a plurality of pins 400 extending upward from the upper surface of bushing 348. If a user pushes downward on cap 394, such that pins 400 are received in the holes, cap 394 becomes rotationally fixed to bushing 348. Assuming ratchet wheel 320 is held in place rotationally, e.g. by a socket secured on a workpiece or in a socket holder or by hand, if the user then rotates cap 394, the interengagement between pins 400 and the cap holes transfers torque to the bushing, which rotates with respect to the ratchet wheel. This compresses the semi-circular spring between the bushing and flange 390, thereby pushing pin flange 390 out of slot 392 and allowing pin 358 to move axially through-holes 356 and 366 with respect to the bushing and the ratchet wheel. At this point, the user may push down on pin 358, thereby causing the opposing angled surfaces of the flange's edge 388 and the plunger's vertically extending edge to move with respect to each other, thereby pushing plunger 364 to the right, in the perspective of FIG. 16.

Rotation of cap 394 and bushing 348 is in opposition to the force applied by spring 354. Thus, upon release of cap 394, spring 354 biases the bushing and pin 358 back to the normal position, and spring 398 biases cap 394 back to the disengaged position.

Figure 17:
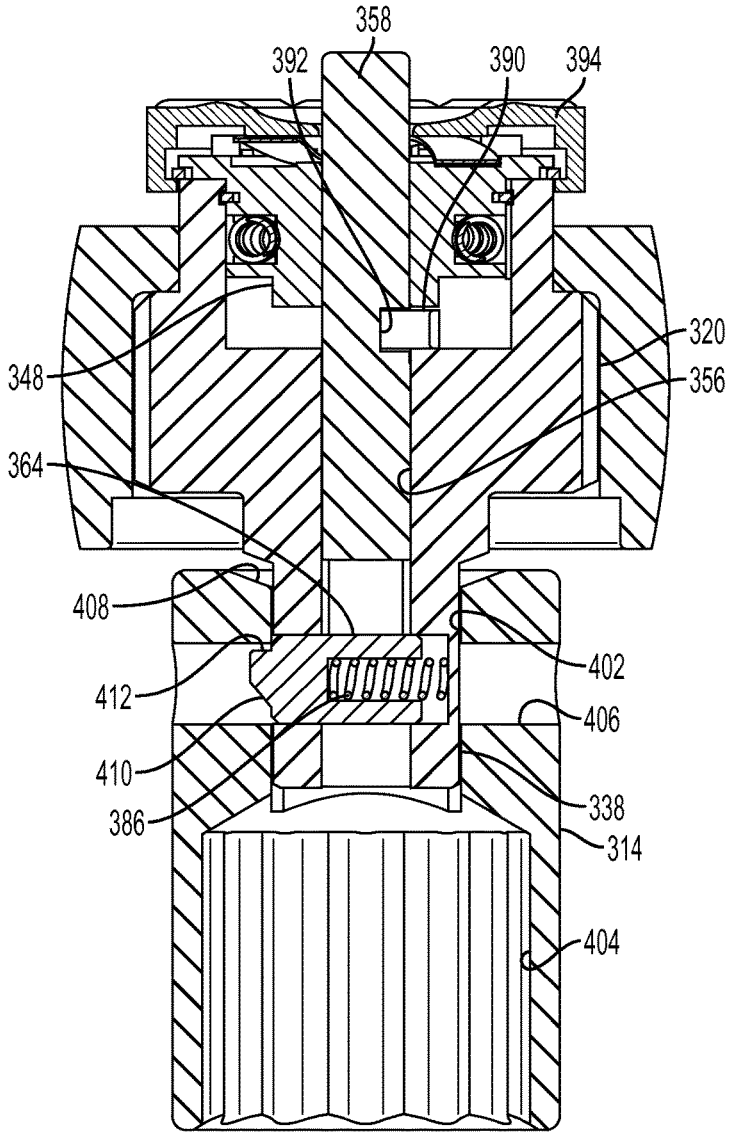
FIG. 17 is a partial sectional view of the ratchet and socket system shown in FIGS. 12A and 12B.

Referring to FIG. 17, socket 314 includes a vertical bore 402 at an upper end of the socket and a second vertical bore 404 at a lower end of the socket. Bore 404 is configured to receive and engage a workpiece, as should be well understood in the art. The particular configuration of the working end of the socket is not, in and of itself, a part of the present invention and is, therefore, not discussed in further detail herein. Upper bore 402 is shaped correspondingly to tang 338 of ratchet wheel 320 so that the upper bore receives the tang. The upper end of socket 314 defines a radially-directed through-bore 406. Upon insertion of the tang into bore 402, a leading edge 408 of the upper surface of socket 314 engages a chamfered surface 410 of plunger 364, thereby pushing plunger 364 to the right (in the perspective of FIG. 17) against the opposing force provided by spring 386. As the tang moves further into bore 402 and plunger 364 aligns with bore 406, the leading end 410 is allowed to move to the left, into bore 406, in accordance with the bias provided by spring 386, as shown in FIG. 17. A shelf 412 at a distal end of plunger 364 is parallel to the radial direction (with regard to the axis of through-hole 356 and pin 358), and parallel to the cylindrical inner diameter surface of bore 406, so that downward force applied to socket 314 causes these opposing surfaces to abut, but does not push plunger 364 to the right. Accordingly, socket 314 is locked in position on the tang. To remove the socket in this embodiment, the user must exercise a multi-step procedure, first pushing downward on cap 394 to engage the cap and pins 400 on bushing 348, then rotating cap 394 and bushing 348 to disengage flange 390 from pin 358 and thereby allow pin 358 to move relative to the ratchet wheel in the axial direction, and then allowing the user to push down on pin 358 to thereby disengage plunger 364 from bore 406, allowing removal of socket 314 from ratchet wheel tang 338.

Figure 15:
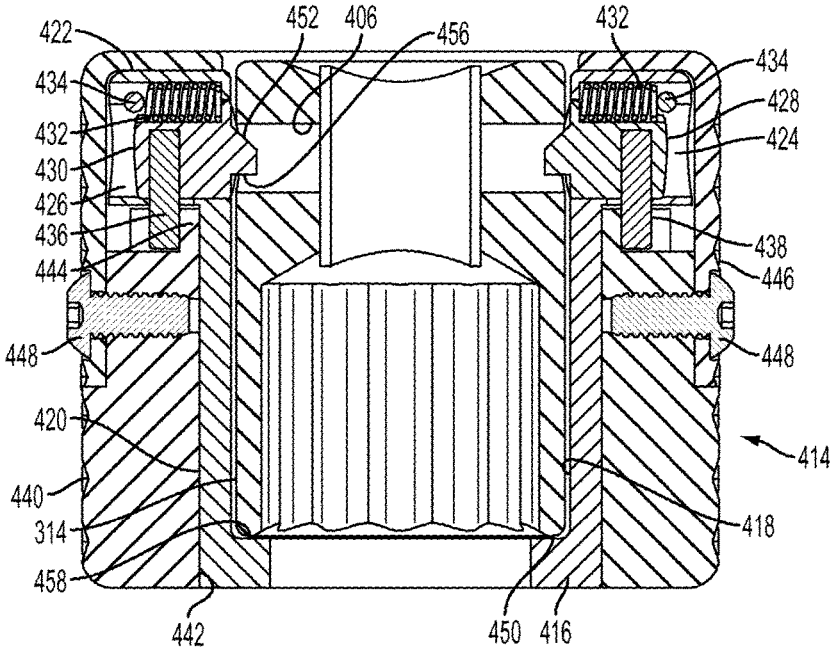
FIG. 15 is a sectional view of the socket and socket retention mechanism shown in FIG. 14.

Referring to FIGS. 15 and 16, a socket holder 414 has an inner body 416 that defines a countersunk bore 418 to receive socket 314. Inner body 416 has a generally cylindrical outer surface 420 along most of its length, but at a top end defines a cylindrical flange 422 that extends radially outwardly from surface 420. A pair of radially-extending bores 424 and 426 extends through inner body 416 through flange 422. In each of bore portions 424 and 426 are received respective plungers 428 and 430. Each plunger includes a respective coil spring 432 in a countersunk bore formed in the plunger. Each spring extends between a pin 434 and closed end of the countersunk bore. Each pin 434 is fixed to inner body 416, and specifically flange 422, so that spring 432 biases plungers 428 and 430 radially inward in bore portions 424 and 426. Respective pins 436 and 438 extend downwardly from the plungers. An outer body 440 defines a generally cylindrical inner diameter 442 that receives inner body 416. Surface 442 opposes surface 420 with sufficient clearance so that inner body 416 and outer body 440 are rotatable with respect to each other. An upper portion of outer body 440 ends just below flange 422 but defines an upper cylindrical flange 444 that opposes pins 436 and 438 in the radial direction. Outer body 440 includes a cover 446 that has a generally cylindrical portion that covers cylindrical flange 422 of inner body 416 and an upper part of the main portion of body 440. The main portion and the cover portion are fixed to each other by screws 448.

Referring also to FIGS. 19A-19G, when a user has secured a socket 314 onto tang 338 in a manner such as described above, the user may insert the socket into bore 418 of holder 414. The socket's leading edge 450 engages chamfered surfaces 452 of plungers 428 and 430. Due to the angle of the chamfered surfaces, the socket's continued movement in the downward axial direction with respect to the socket holder pushes plungers 428 and 430 radially outward in bores 424 and 426, against the opposing forces of springs 432. As the user continues to push the socket down into bore 418, bores 424 and 426 eventually align with bore 406, at which point springs 432 bias plungers 428 and 430 radially inward so that the plungers' radially inward distal ends extend into bore 406. The plunger distal ends' bottom surfaces 456 are generally parallel to the radial direction (with respect to the axis of through-hole 356 and pin 358), and to the radially-extending inner diameter surface of bore 406, so that socket 314 is now secured within holder 414 by surfaces 456 (in the upward axial direction) and counterbore surface 458 (in the downward axial direction). The user may then conduct the three-step release procedure described above to allow removal of tang 338 from the socket, thereby leaving the socket securely in place in holder 414. As described above with respect to the embodiment of FIGS. 7-11B, the socket holder's lower retaining member flange has a dimension in the direction transverse to the socket/retaining volume axis that extends into a perimeter of an area defined by the socket working end's outer diameter, while the upper flange (plungers 428 and 430) extend within the same perimeter but do not extend into the perimeter of the socket's tang bore 406.

To remove the socket from holder 414, the user re-inserts tang 438 into the socket, so that plunger 364 again engages bore 406. The user grips outer body 440 of holder 414 and rotates the holder about the axis of bore 356 and pin 358 while holding the ratchet in a still position. Because of the engagement between plungers 428 and 430 in bore 406, this holds inner body 416 still as the user rotates outer body 440. Alternatively, outer body 440 is fixed to a base, so that the user's rotation of the ratchet about the axis of pin 358 rotates the socket and inner body 416 with respect to outer body 440. Cylindrical flange 444 defines a cam surface (not shown) that, as outer body 440 rotates with respect to inner body 416, pushes pins 436 and 438 radially outward, thereby causing plungers 428 and 430 to move radially outward and disengage from bore 406, allowing the user (by pulling upward on the ratchet) to pull tang 338 and socket 314 upward and out of bore 418.

Figure 18A:
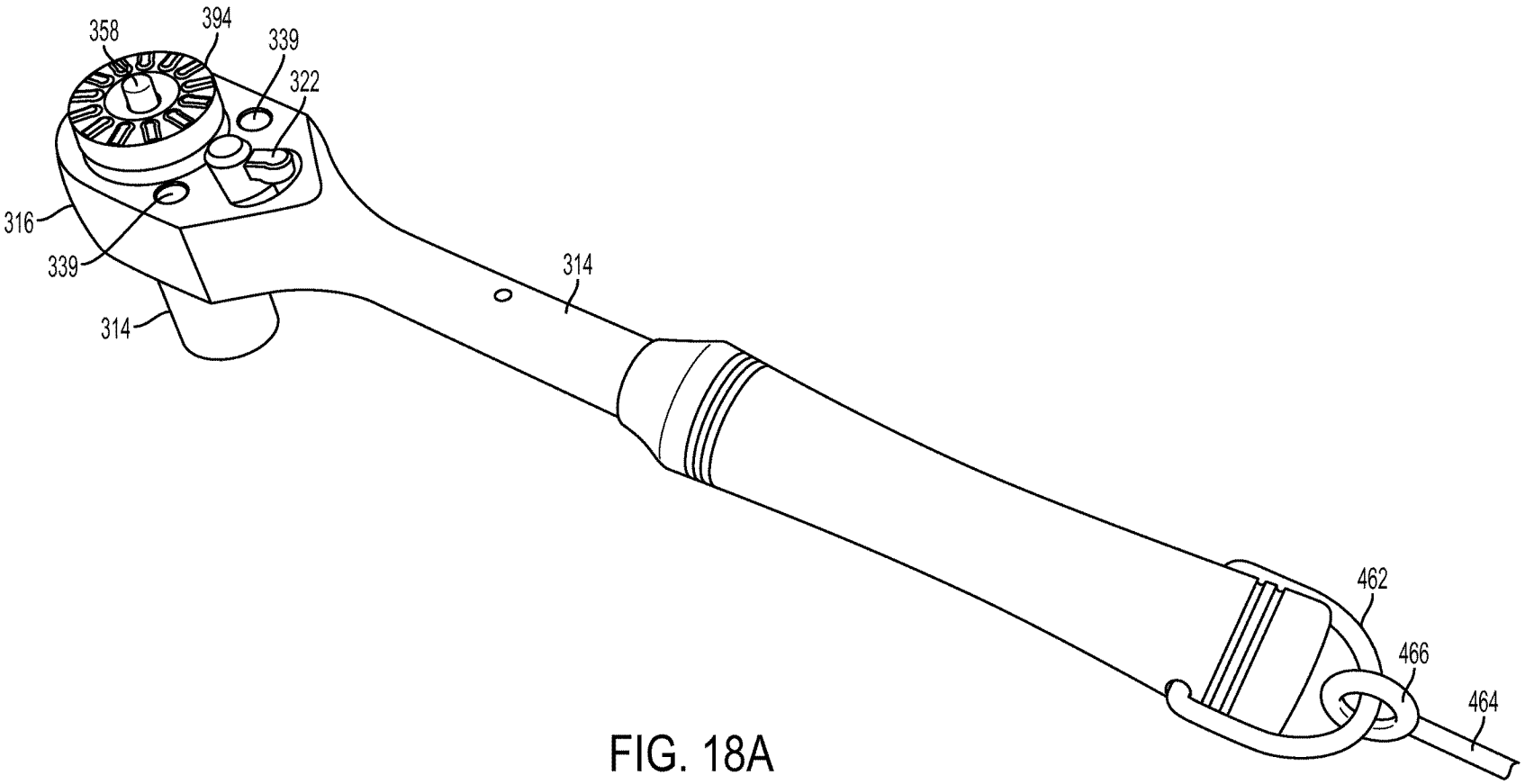
FIGS. 18A and 18B are perspective views of ratchet and socket systems according to embodiments of the present invention.
Figure 18B:
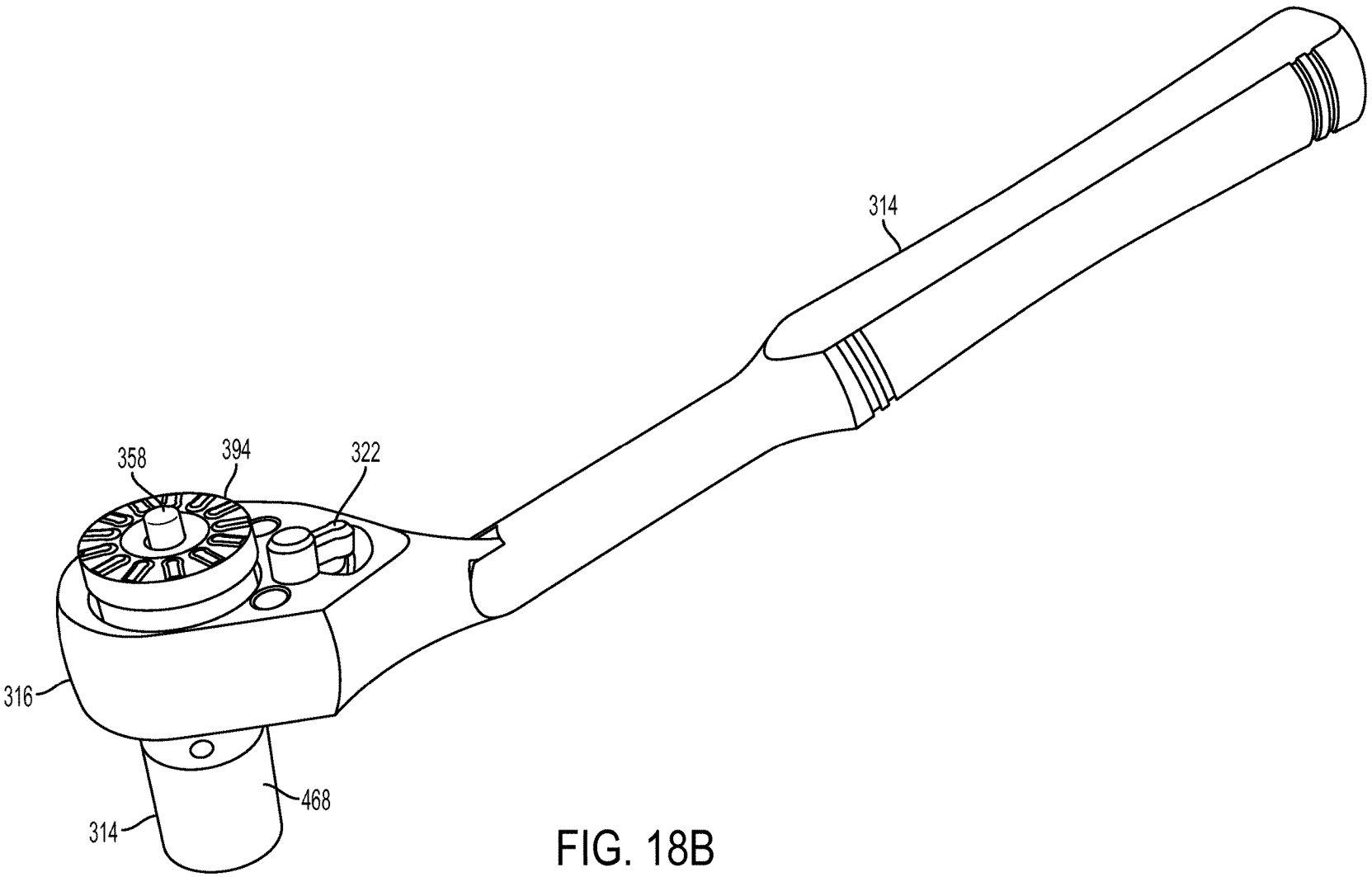

Referring again to FIG. 12A, ratchet handle 314 may include a ring 462 fixed by various means to a distal end of the handle opposite head 316, for example by welding, forging or by securing ring 462 with a pin (not shown) that extends through a hole drilled through the end of the handle's distal end. A tether 464 may be secured to ring 462 by a ring 466 that is woven with or stitched to the tether. The opposite end of tether 464 (not shown) may be secured to a worker, a workpiece, or other structure such as a work bucket, by various means. Knurling may also be applied to an outer surface of socket 314, as indicated at 468, to facilitate a more secure grip by a user. As noted, other handle configurations may be used, for example a cushion grip, as shown at FIG. 18A. A locking flex head design may also be utilized, as shown at FIG. 18B and described, for example, at U.S. Pat. No. 5,199,335.

Figure 19A:
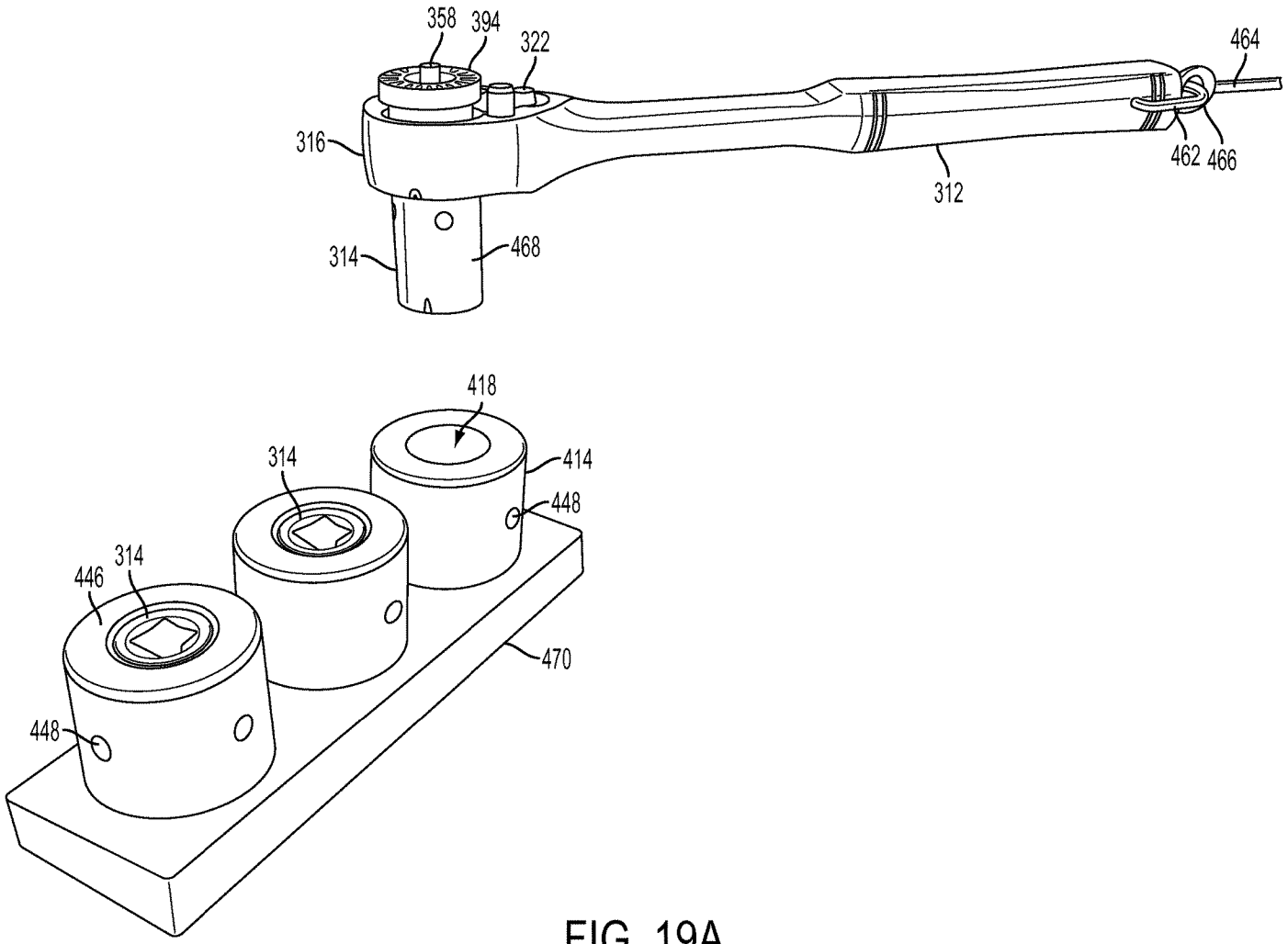
FIGS. 19A, 19B, 19C, 19D, 19E, 19F and 19G illustrate embodiments of mechanism to secure sockets.
Figure 19B:
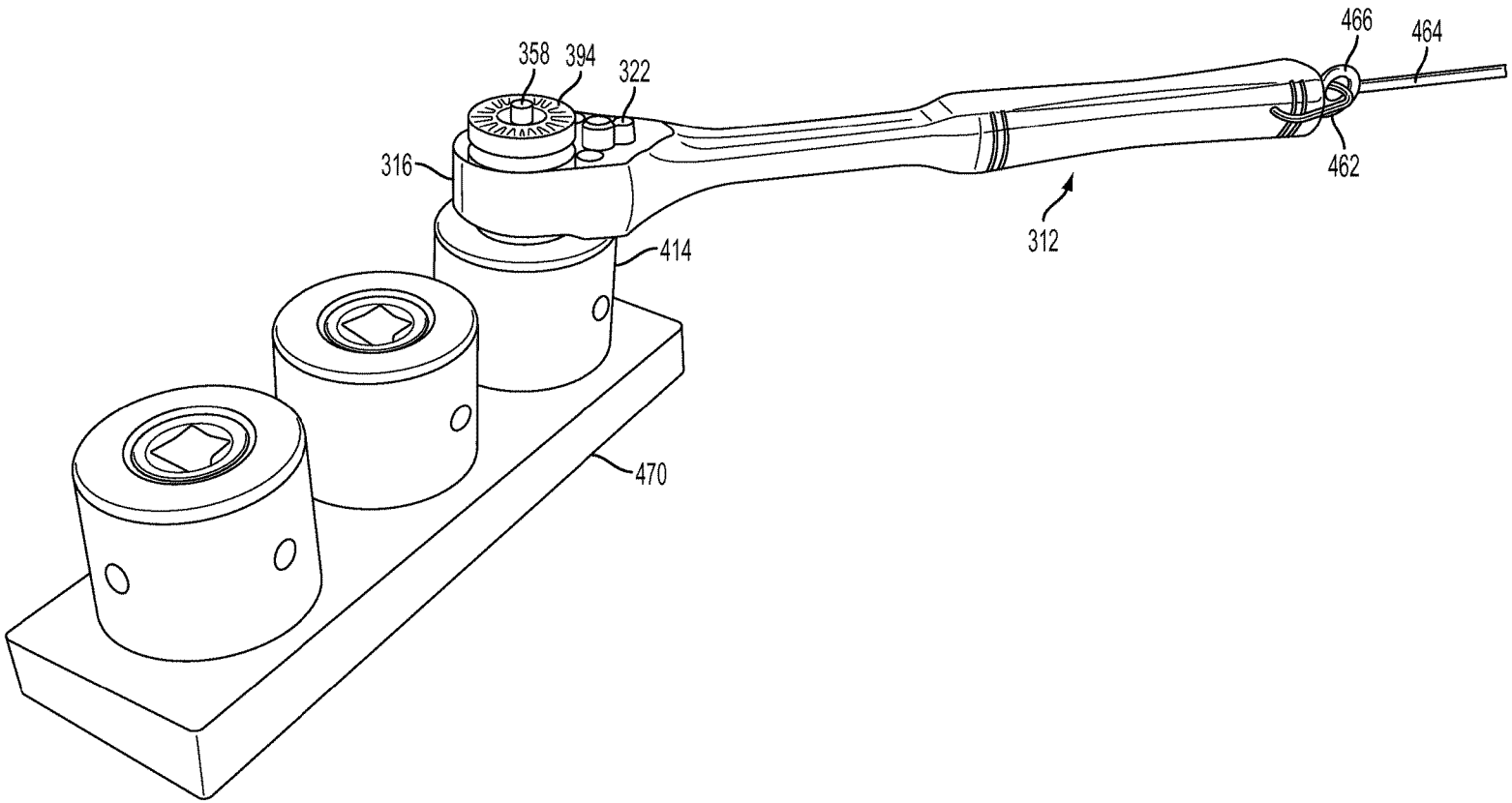
Figure 19C:
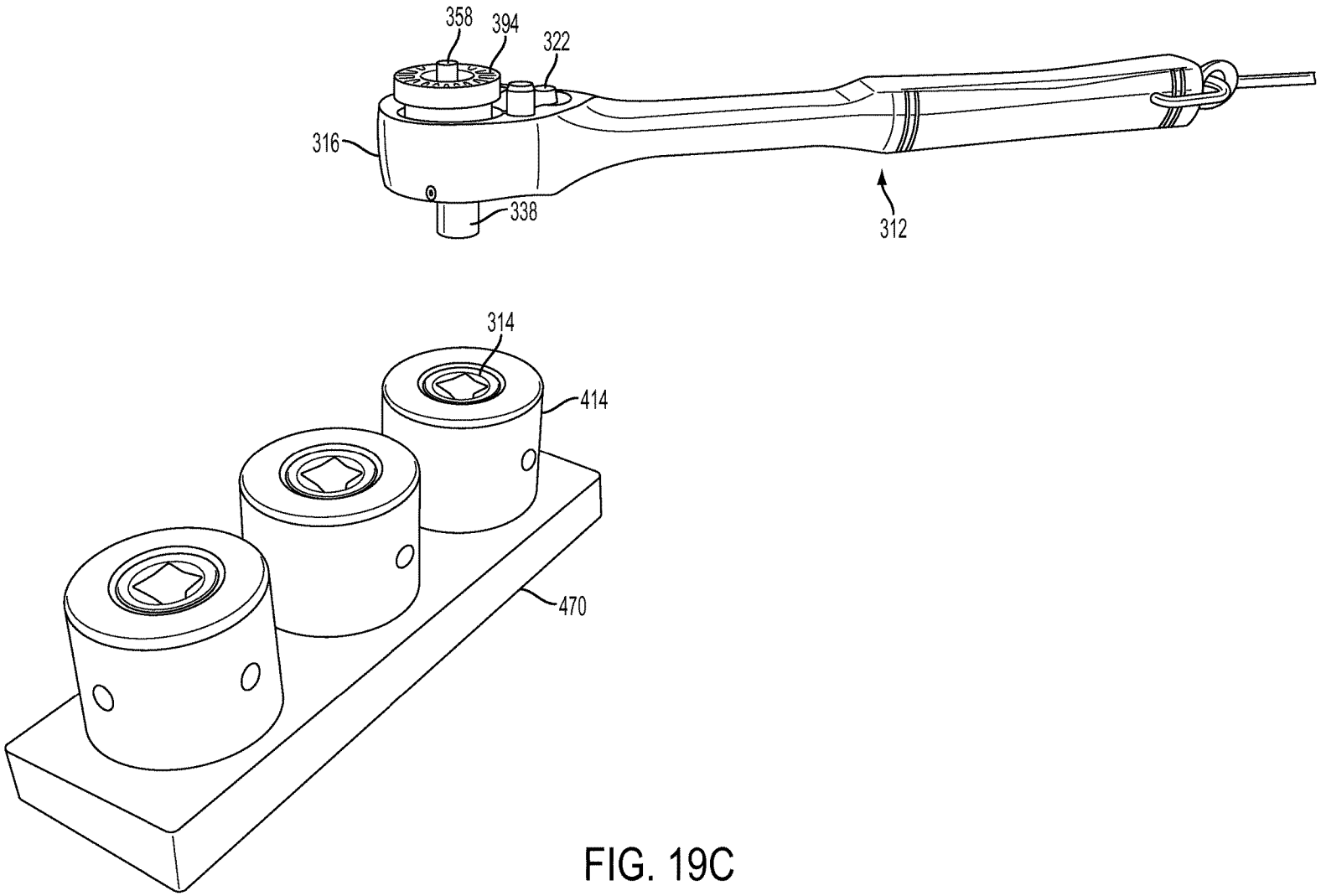
Figure 19D:
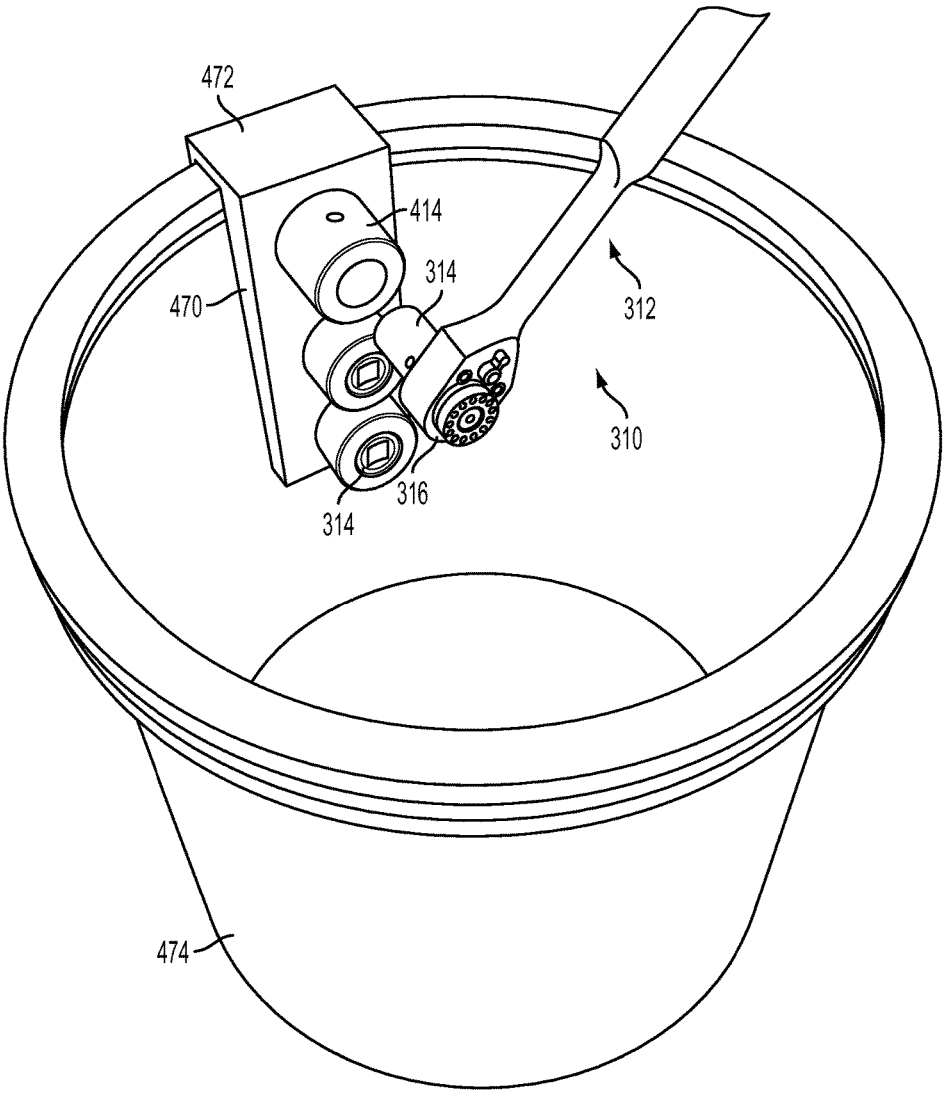
Figure 19E:
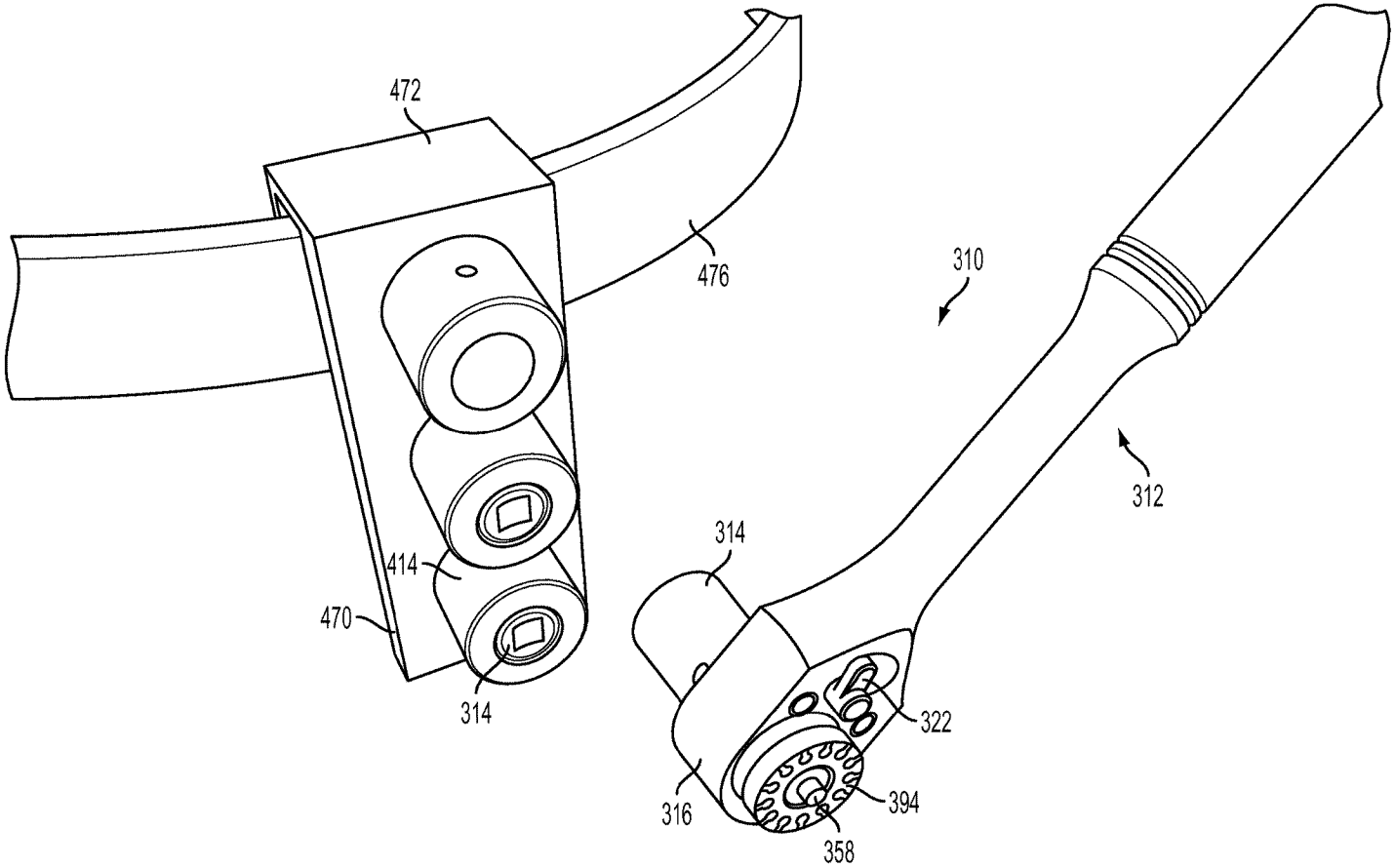
Figure 19F:
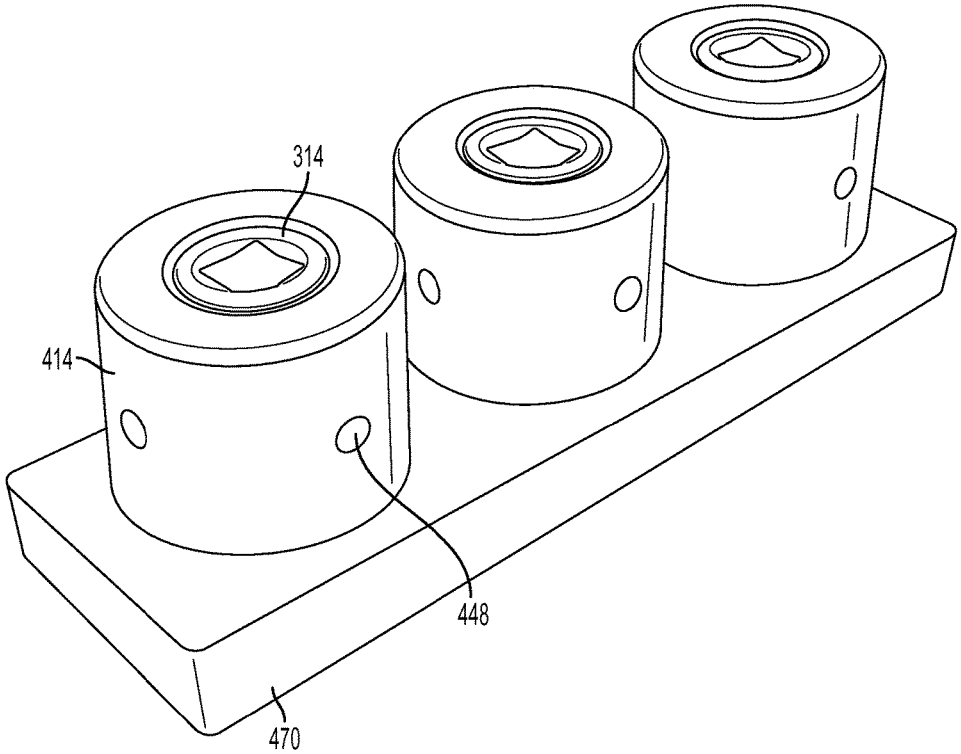
Figure 19G:
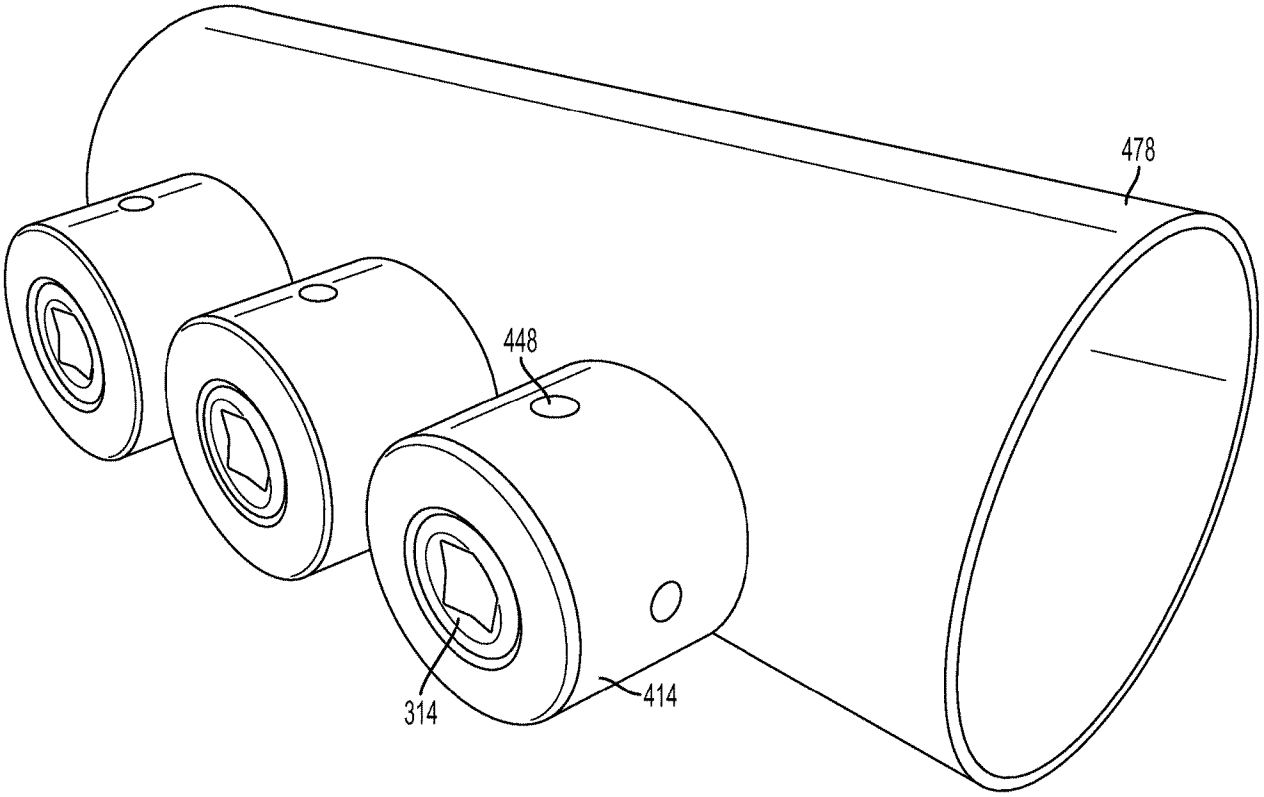

Referring to FIGS. 19A-19G, it will be understood that socket holders 414 may be utilized in a variety of configurations. For example, referring to FIG. 19F and FIG. 16, where inner body 416 and/or outer body 414 is made from a metallic material, the magnetic holders may be secured on a magnetic base member 470. As shown in FIG. 19F, three socket holders 414 are disposed on base 470. Each holder defines a diameter of bore 418 corresponding to a predetermined socket size to be received by that holder. An upper end 472 of base 470 may be formed in a U-shape so that the holder may be placed onto an edge of a convenient utensil, for example a bucket 474 or the user's belt 476, as shown in FIGS. 19D and 19E, respectively, allowing the user to mount base 470 and holders 414 on an object already at the work site or on the user's person. For example, the socket holder's outer body 440 may be made of a ferrous or magnetic material that attracts and secures to a correspondingly attractive ferrous or magnetic material of base 470, or outer body 440 and base 470 may be formed integrally with each other or mechanically attached to each other, so that inner body 416 is rotatable with respect to both outer body 440 and base 470. As shown in FIG. 19G, socket holders 414 may be secured to an arm band 478, for example through magnetism or a fixed mechanical connection.

Figure 20A:
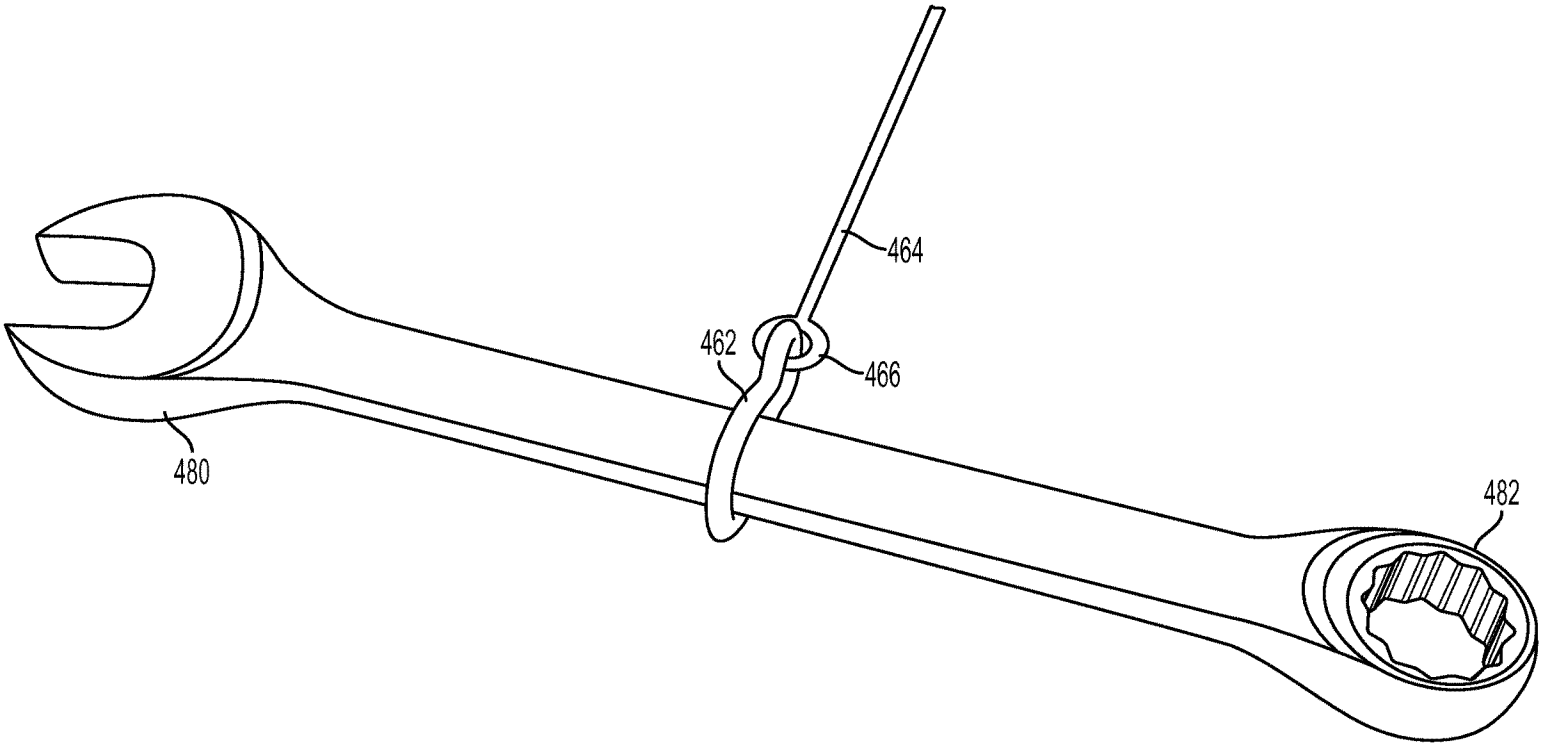
FIGS. 20A, 20B, 20C and 20D illustrate embodiments of the present invention regarding a mechanism for securing a tool such as a wrench or ratcheting wrench.

Referring to FIGS. 20A-20D, ring 462 and tether 464, connected by intermediate ring 466, may be used to secure various other tools to a user's body or work. FIG. 20A illustrates a ring 462 disposed about the body of a combination wrench at the handle portion of the body. Ring 462 may be a carabiner style ring, so that the ring may be attached to an already-forged wrench. The opposing ends and 480 and 482 of the combination wrench have dimensions wider than the inner diameter of ring 462, thereby allowing ring 462 to slide on the body portion, but retaining the attachment between ring 462 (and, therefore, tether 464) and the wrench.

Figure 20B:
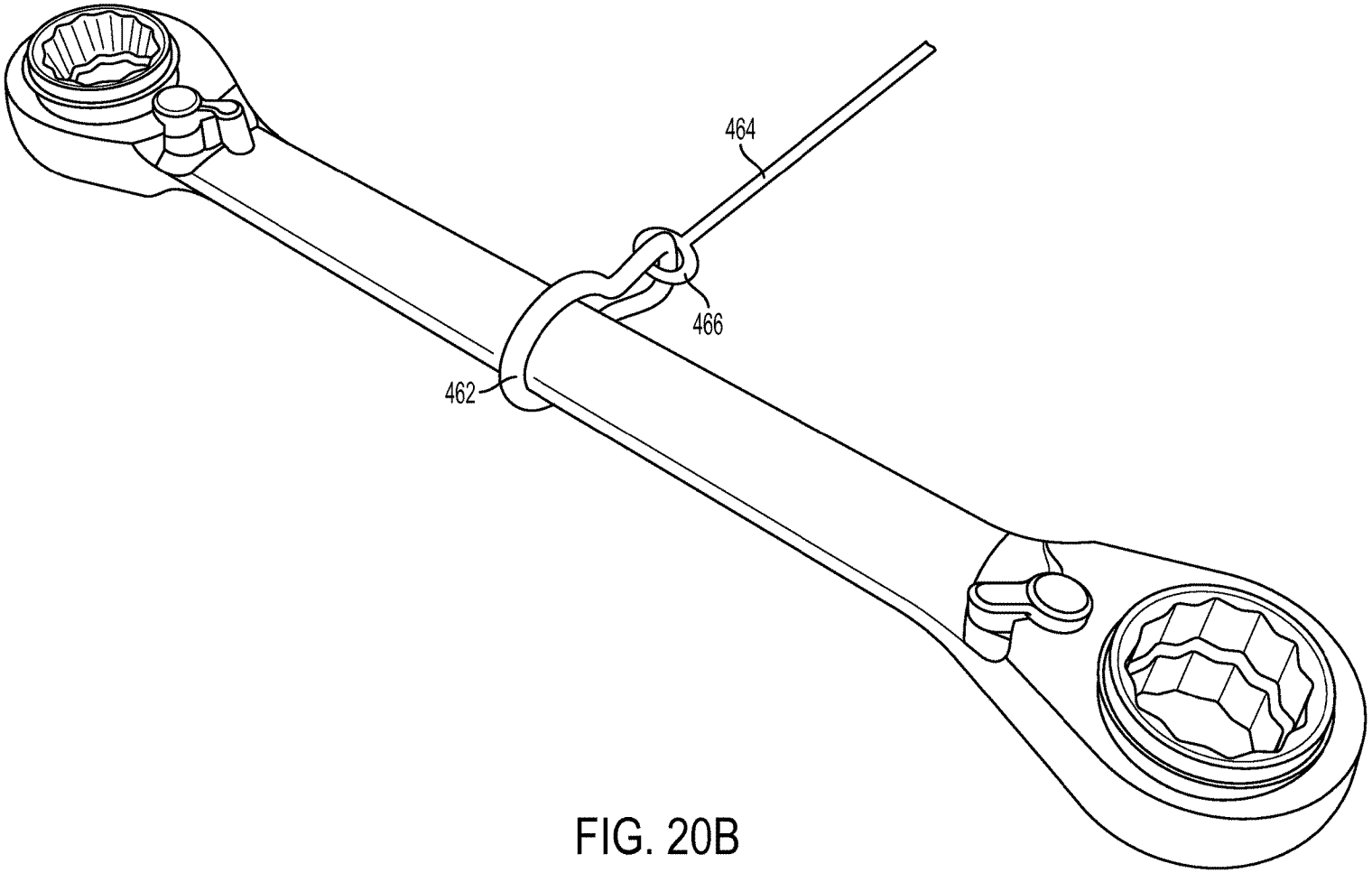
Figure 20C:
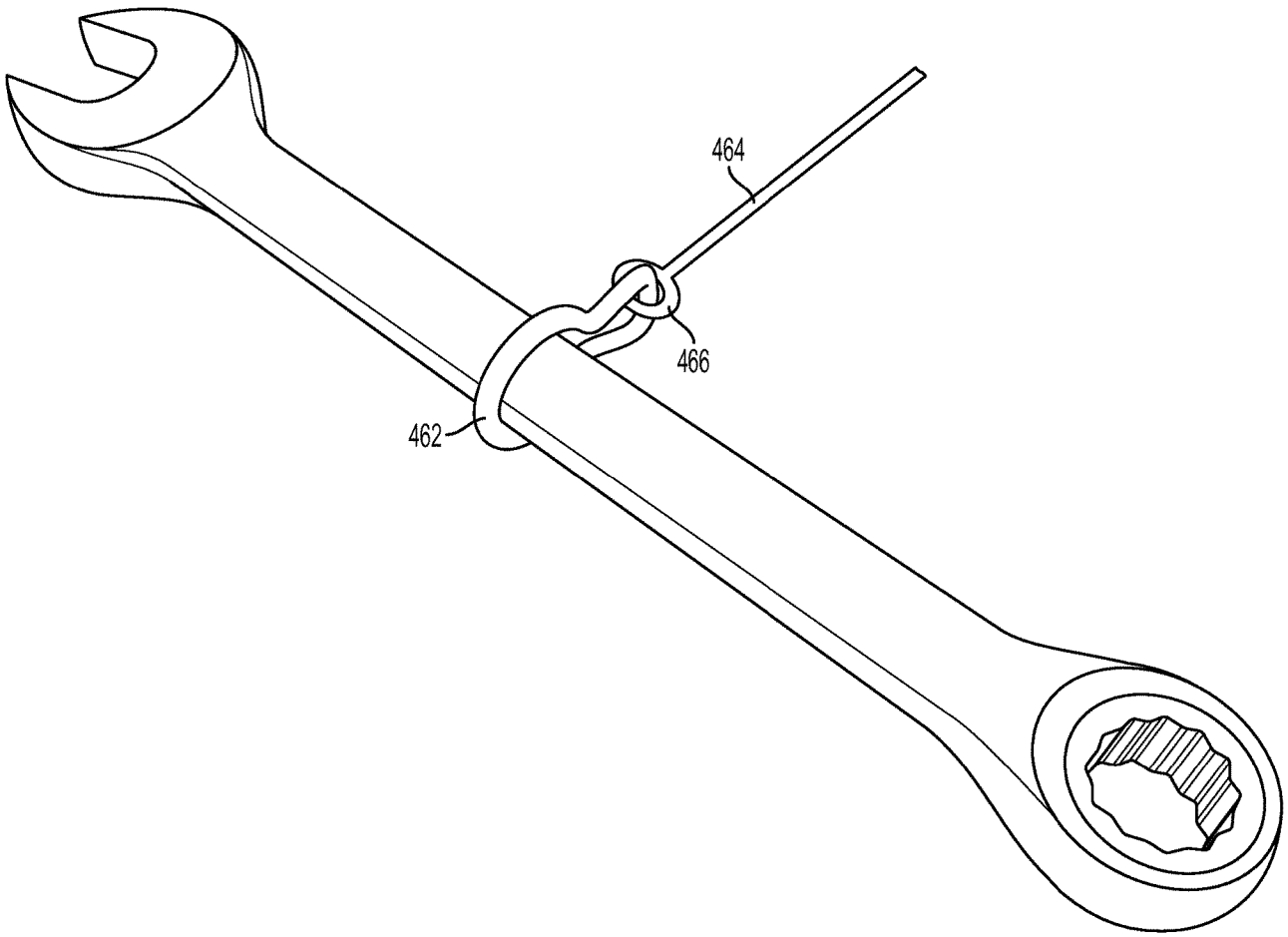
Figure 20D:
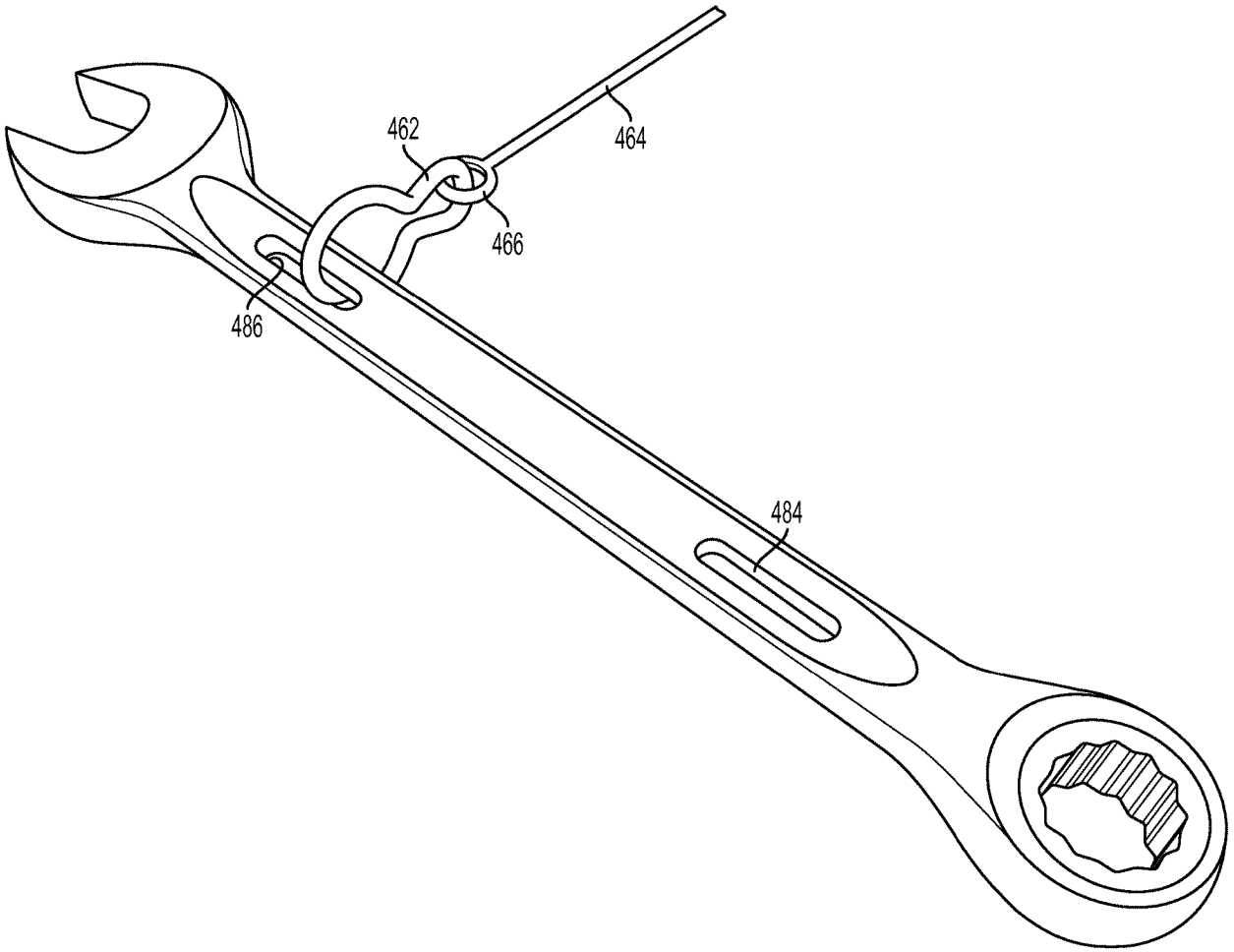

FIGS. 20B and 20C illustrate similar configurations with different types of wrenches. FIG. 20D illustrates a wrench with a pair of through-slots 484 and 486. Ring 462 passes through one of the slots, thereby securing the wrench to the ring and tether.

While one or more embodiments of the present invention have been described above, it should be understood that any and all equivalent realizations of the present invention are included within the scope and spirit thereof. Thus, the embodiments presented herein are by way of example only and are not intended as limitations of the present invention. Therefore, it is contemplated that any and all such embodiments are included in the present invention.

What is claimed is:

1. A ratcheting tool for driving a socket, the ratcheting tool comprising:

a body having a head that defines a cavity and having an elongated handle extending away from the head;

a ratchet member comprising an annular ratchet portion disposed in the cavity so that the ratchet portion is rotatable about an axis and a drive tang extending from the ratchet portion externally of the body and so that the drive tang rotates with the ratchet portion about the axis;

a pawl disposed in the body in communication with the ratchet portion selectively between a first position in which the pawl transmits torque from the body to the ratchet portion in a first rotational direction with respect to the axis and ratchets with respect to the ratchet portion in response to torque from the body in a second rotational direction with respect to the axis opposite the first direction, and a second position in which the pawl transmits torque from the body to the ratchet portion in the second rotational direction and ratchets with respect to the ratchet portion in response to torque from the body in the first rotational direction;

a detent disposed in the drive tang so that the detent is reciprocally movable in a direction transverse to the axis between a first position and a second position, wherein the first position of the detent extends further from the axis than does the second position of the detent;

a linkage extending through the drive tang to engagement with the detent, wherein the linkage is accessible at a surface of the ratcheting tool, wherein the linkage engages the detent so that when the linkage is in a first position, the detent is in its first position and so that actuation of the linkage to a second position causes the linkage to move the detent to its second position; and a locking element that defines a flange and that is attached to the ratchet member pivotally about an axis that is offset from the ratchet portion axis and that passes through the ratchet portion, the locking element being pivotal between a first position wherein the flange engages a groove defined by the linkage when the linkage is in its first position so that the locking element blocks the actuation of the linkage and a second position in which the flange disengages from the linkage with respect to the locking element's first position.

2. The ratcheting tool of claim 1, wherein the detent is a cylindrical pin.

3. The ratcheting tool of claim 1, wherein the linkage comprises an elongated pin that extends longitudinally through the ratchet portion and the tang into engagement with the detent.

4. The ratcheting tool of claim 3, wherein the elongated pin and the detent define opposed surfaces that are in abutment with each other at an oblique angle with respect to an axis of the drive tang.

5. The ratcheting tool of claim 1, further comprising an actuator disposed on and movably with respect to the body in communication with the locking element so that movement of the actuator moves the locking element between its first and second positions.

6. A ratcheting tool for driving a socket, comprising:

a body having a head that defines a first compartment and having an elongated handle extending longitudinally away from the head, wherein the elongated handle defines a longitudinal first axis and wherein the body defines a second compartment that communicates with the first compartment;

an annular ratchet member disposed in the first compartment so that the ratchet member is rotatable about a second axis that is perpendicular to the first axis, wherein the ratchet member defines a plurality of ratchet teeth on an outer circumference thereof;

a pawl disposed in the second compartment defined by the body so that the pawl is movable in the second compartment between a first position in which the pawl transmits torque from the body to the ratchet member in a first rotational direction with respect to the second axis and ratchets with respect to the ratchet member in response to torque from the body in a second rotational direction with respect to the second axis opposite the first direction; and a second position in which the pawl transmits torque from the body to the ratchet member in the second rotational direction and ratchets with respect to the ratchet member in response to torque from the body in the first rotational direction;

a drive tang extending from the ratchet member so that the drive tang rotates with the ratchet member about the second axis;

a detent disposed in the drive tang so that the detent is reciprocally movable between a first position in which the detent extends beyond an outer surface of the drive tang a distance to engage a receiving structure in an internal surface of a socket when received on the drive tang and retain the socket on the drive tang from movement off of the drive tang in a direction along the second axis and a second position inward of the distance with respect to the second axis so that the socket disposed on the drive tang is movable off of the drive tang in the direction along the second axis;

a linkage extending through the ratchet member and the drive tang from the detent to a surface of the ratchet member opposite the drive tang, wherein the linkage comprises a push member at the surface and a first resilient member in communication with the push member so that the first resilient member biases the push member to a first position, wherein the push member is linked to the detent through the linkage so that when the push member is in its first position, the detent is in its first position and so that actuation of the push member against the bias to a second position moves the linkage to drive the detent to its second position;

a locking element disposed pivotally with respect to the ratchet member;

a second resilient element disposed between the ratchet member and the locking element so that the second resilient element biases the locking element toward engagement with the linkage, wherein the locking element and the linkage are disposed and configured with respect to each other so that, when the locking element engages the linkage in response to bias from the second resilient element when the push member is in its first position, the locking element blocks movement of the push member from its first position to its second position; and an actuator disposed at the surface movably with respect to the linkage and in communication with the locking element so that movement of the actuator moves the locking element away from engagement with the linkage.

7. The ratcheting tool of claim 6, wherein the detent is a cylindrical pin.

8. The ratcheting tool of claim 6, wherein the linkage comprises an elongated pin including the push member, the elongated pin extending longitudinally through the ratchet member and the drive tang into engagement with the detent.

9. The ratcheting tool of claim 8, wherein the elongated pin and the detent include opposed surfaces that are in abutment with each other at an oblique angle with respect to an axis of the drive tang.

10. The ratcheting tool of claim 9, wherein the detent is a cylindrical pin.

11. The ratcheting tool of claim 6, wherein the second resilient element is a coil spring in communication at a first end of the coil spring with the actuator and at a second end of the coil spring with the locking element.

12. The ratcheting tool of claim 11, wherein the actuator comprises a cap disposed rotatably on the ratchet member at the surface, the push member extending upwardly through a center opening of the cap.

13. The ratcheting tool of claim 6, wherein the push member is an elongated pin that defines a groove that selectively receives a portion of the locking element.

14. The ratcheting tool of claim 13, wherein the locking element is pivotally attached to the ratchet member about an axis offset from and parallel to the second axis, and wherein the portion of the locking element that is selectively received in the groove of the elongated pin is a flange.

15. The ratcheting tool of claim 6, wherein the push member is an elongated pin defining a groove extending into the elongated pin in a direction transverse to the second axis, the actuator comprises an annular member surrounding the elongated pin, the locking element is a C-shaped member that is pivotally received in a bore defined in the ratchet member about an axis offset from and parallel to the second axis, the C-shaped member including a radially extending flange, and the annular member engages the C-shaped member so that the annular member is rotatable between a first position in which the radially extending flange is received in the groove of the elongated pin and a second position in which the radially extending flange is removed from the groove of the elongated pin.

16. The ratcheting tool of claim 15, wherein the annular member is rotatably secured to the ratchet member, and the annular member is biased into the first position of the annular member by the second resilient element.

17. A ratcheting tool for driving a socket, the ratcheting tool comprising:

a body having a head that defines a cavity and having an elongated handle extending away from the head;

a ratchet member comprising an annular ratchet portion disposed in the cavity so that the ratchet portion is rotatable about an axis and a drive tang extending from the ratchet portion externally of the body and so that the drive tang rotates with the ratchet portion about the axis;

a pawl disposed in the body in communication with the ratchet portion selectively between a first position in which the pawl transmits torque from the body to the ratchet portion in a first rotational direction with respect to the axis and ratchets with respect to the ratchet portion in response to torque from the body in a second rotational direction with respect to the axis opposite the first direction, and a second position in which the pawl transmits torque from the body to the ratchet portion in the second rotational direction and ratchets with respect to the ratchet portion in response to torque from the body in the first rotational direction;

a detent disposed in the drive tang so that the detent is reciprocally movable in a direction transverse to the axis between a first position and a second position, wherein the first position of the detent extends further from the axis than does the second position of the detent;

a linkage extending through the drive tang to engagement with the detent, wherein the linkage is accessible at a surface of the ratcheting tool, wherein the linkage engages the detent so that when the linkage is in a first position, the detent is in its first position and so that actuation of the linkage to a second position causes the linkage to move the detent to its second position; and a locking element that defines a flange and that is disposed within the cavity and attached to the ratchet portion pivotally about an axis that is offset from the ratchet portion axis and that passes through the ratchet portion so that the locking element is pivotable between a first position wherein the flange engages a groove defined by the linkage when the linkage is in its first position so that the locking element blocks the actuation of the linkage and a second position in which the flange disengages from the linkage with respect to the locking element's first position.

18. The ratcheting tool of claim 17, wherein the detent is a cylindrical pin.

19. The ratcheting tool of claim 17, wherein the linkage comprises an elongated pin that extends longitudinally through the ratchet portion and the tang into engagement with the detent.

20. The ratcheting tool of claim 19, wherein the elongated pin and the detent define opposed surfaces that are in abutment with each other at an oblique angle with respect to an axis of the drive tang.

21. The ratcheting tool of claim 17, further comprising an actuator disposed on and movably with respect to the body in communication with the locking element so that movement of the actuator moves the locking element between its first and second positions.

22. The ratcheting tool of claim 17, wherein the linkage engages the detent so that when the linkage is in its first position, the linkage positively maintains the detent in its first position.

* * * * *